US006139703A

United States Patent [19]

Hanson et al.

[11] Patent Number: 6,139,703

[45] Date of Patent: Oct. 31, 2000

[54] CATHODE CURRENT CONTROL SYSTEM FOR A WAFER ELECTROPLATING APPARATUS

[75] Inventors: Kyle M. Hanson; K. Chris Haugan; Kevin W. Coyle, all of Kalispell; James Doolittle, Whitefish, all of Mont.; Robert W. Berner, Eagle, Id.

[73] Assignee: Semitool, Inc., Kalispell, Mont.

[21] Appl. No.: 09/466,688

[22] Filed: Dec. 20, 1999

Related U.S. Application Data

[62] Division of application No. 08/933,450, Sep. 18, 1997, Pat. No. 6,004,440.

[51] Int. Cl.[7] ..... C25D 17/01

[52] U.S. Cl. ..... 204/212; 204/230.2

[58] Field of Search ..... 204/212, 230.2

[56] References Cited

U.S. PATENT DOCUMENTS

| | | | |
|---|---|---|---|
| 3,644,190 | 2/1972 | Weist et al. | 204/228 |
| 3,880,725 | 4/1975 | Van Raalte et al. | 204/15 |
| 4,304,641 | 12/1981 | Grandia et al. | 204/23 |
| 4,534,832 | 8/1985 | Doiron, Jr. | 204/15 |
| 5,135,636 | 8/1992 | Yee et al. | 205/96 |
| 5,227,041 | 7/1993 | Brogden et al. | 204/297 |
| 5,744,019 | 4/1998 | Ang | 205/96 |

*Primary Examiner*—Kathryn Gorgos
*Assistant Examiner*—Erica Smith-Hicks
*Attorney, Agent, or Firm*—Rockey, Milnamow & Katz, Inc.

[57] ABSTRACT

A cathode current control system employing a current thief for use in electroplating a wafer is set forth. The current thief comprises a plurality of conductive segments disposed to substantially surround a peripheral region of the wafer. A first plurality of resistance devices are used, each associated with a respective one of the plurality of conductive segments. The resistance devices are used to regulate current through the respective conductive finger during electroplating of the wafer. Various constructions are used for the current thief and further conductive elements, such as fingers, may also be employed in the system. As with the conductive segments, current through the fingers may also be individually controlled. In accordance with one embodiment of the overall system, selection of the resistance of each respective resistance devices is automatically controlled in accordance with predetermined programming.

28 Claims, 28 Drawing Sheets

CATHODE CURRENT CONTROL SYSTEM FOR A WAFER ELECTROPLATING APPARATUS

CROSS-REFERENCE TO RELATED APPLICATIONS

This application is a divisional of U.S. patent application Ser. No. 08/933,450, filed Sep. 18, 1997, entitled "Cathode Current Control System for a Wafer Electroplating Apparatus now U.S. Pat. No. 6,004,440.

STATEMENT REGARDING FEDERALLY SPONSORED RESEARCH OR DEVELOPMENT

Not Applicable

BACKGROUND OF THE INVENTION

Most inorganic and some organic chemical compounds, when in a molten state or when dissolved in water or other liquids, become ionized; that is, their molecules become dissociated into positively and negatively charged components, which have the property of conducting an electric current. If a pair of electrodes is placed in a solution of an electrolyte, or an ionizable compound, and a source of direct current is connected between them, the positive ions in the solution move toward the negative electrode and the negative ions toward the positive. On reaching the electrodes, the ions may gain or lose electrons and be transformed into neutral atoms or molecules, the nature of the electrode reactions depending on the potential difference, or voltage, applied.

The action of a current on an electrolyte can be understood from a simple example. If the salt copper sulfate is dissolved in water, it dissociates into positive copper ions and negative sulfate ions. When a potential difference is applied to the electrodes, the copper ions move to the negative electrode, are discharged, and are deposited on the electrode as metallic copper. The sulfate ions, when discharged at the positive electrode, are unstable and combine with the water of the solution to form sulfuric acid and oxygen. Such decomposition caused by an electric current is called electrolysis.

Electrolysis has industrial applicability in a process known as electroplating. Electroplating is an electrochemical process for depositing a thin layer of metal on, usually, a metallic base. Objects are electroplated to prevent corrosion, to obtain a hard surface or attractive finish, to purify metals (as in the electrorefining of copper), to separate metals for quantitative analysis, or, as in electrotyping, to reproduce a form from a mold. Cadmium, chromium, copper, gold, nickel, silver, and tin are the metals most often used in plating. Typical products of electroplating are silver-plated tableware, chromium-plated automobile accessories, and tin-plated food containers.

In the process of electroplating, the object to be coated is placed in a solution, called a bath, of a salt of the coating metal, and is connected to the negative terminal of an external source of electricity. Another conductor, often composed of the coating metal, is connected to the positive terminal of the electric source. A steady direct current of low voltage, usually from 1 to 6 V, is required for the process. When the current is passed through the solution, atoms of the plating metal deposit out of the solution onto the cathode, the negative electrode. These atoms are replaced in the bath by atoms from the anode (positive electrode), if it is composed of the same metal, as with copper and silver.

Otherwise they are replaced by periodic additions of the salt to the bath, as with gold and chromium. In either case equilibrium between the metal coming out of solution and the metal entering is maintained until the object is plated.

Recently recognized applications of electroplating relate to the electroplating of a semiconductor wafer. The electroplated metal is used to provide the interconnect layers on the semiconductor wafer during the fabrication of integrated circuit devices. Due to the minute size of the integrated circuit devices, the electroplating process must be extremely accurate and controllable. To ensure a strong and close bond between the wafer to be plated and the plating material, the wafer is cleaned thoroughly using a chemical process, or by making it the anode in a cleaning bath for an instant. To control irregularities in the depth of the plated layer, and to ensure that the grain at the surface of the plated layers is of good quality, the current density (amperes per square foot of cathode surface) and temperature of the wafer must be carefully controlled.

The present inventors have recognized this need for controlling irregularities in the depth of the plated layer across the surface of the wafer. The present invention is directed, among other things, to a solution to this problem.

BRIEF SUMMARY OF THE INVENTION

A cathode current control system employing a current thief for use in electroplating a wafer is set forth. The current thief comprises a plurality of conductive segments disposed to substantially surround a peripheral region of the wafer. A first plurality of resistance devices are used, each associated with a respective one of the plurality of conductive segments. The resistance devices are used to regulate current through the respective conductive finger during electroplating of the wafer.

Various constructions are used for the current thief and further conductive elements, such as fingers, may also be employed in the system. As with the conductive segments, current through the fingers may also be individually controlled. In accordance with one embodiment of the overall system, selection of the resistance of each respective resistance devices is automatically controlled in accordance with predetermined programming.

DETAILED DESCRIPTION OF THE INVENTION

Figure 1:
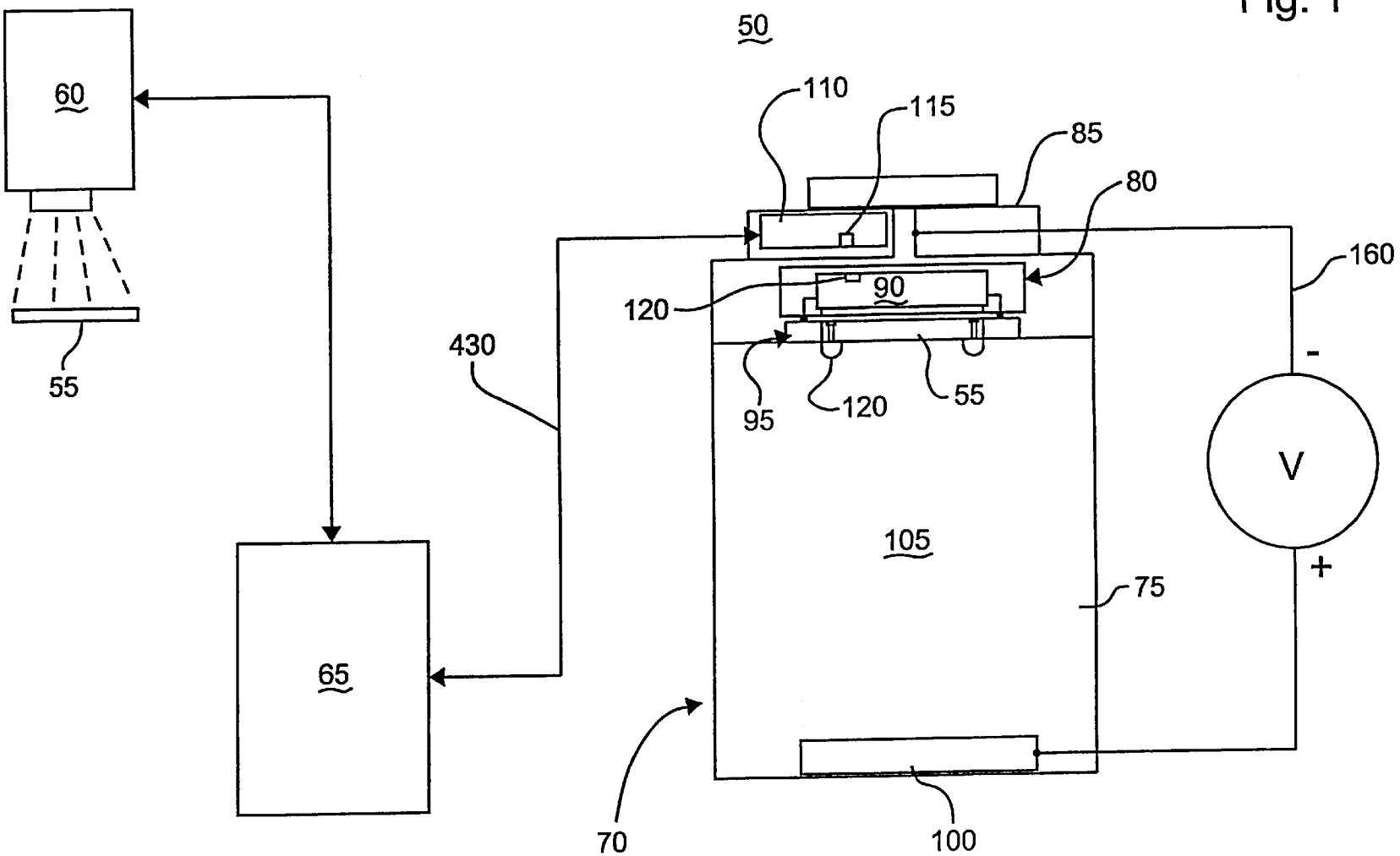
FIG. 1 is a schematic block diagram of an electroplating system constructed in accordance with one embodiment of the invention.
Figure 2:
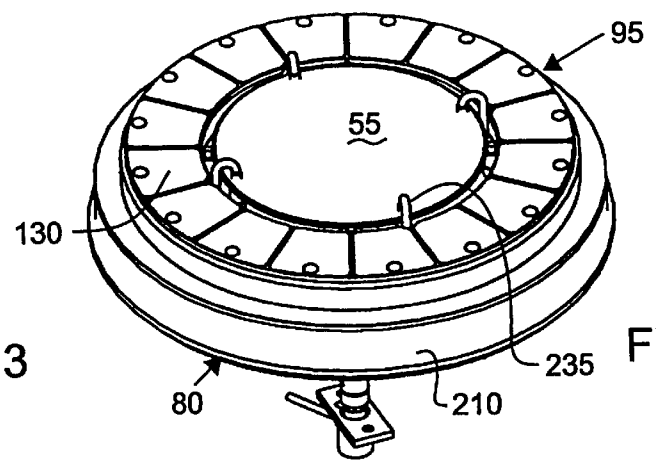
FIGS. 2–6 illustrate various aspects of the construction of a rotor assembly and current thief constructed in accordance with one embodiment of the present invention.
Figure 3:
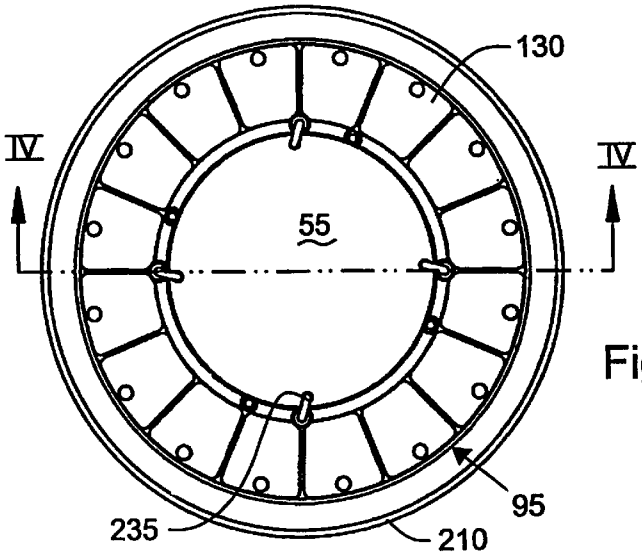

FIG. 1 is a schematic block diagram of a plating system, shown generally at 50, for electroplating a metallization layer, such as a patterned copper metallization layer, on, for example, a semiconductor wafer 55. The illustrated system generally comprises a vision system 60 that communicates with a main electroplating control system 65. The vision system 60 is used to identify the particular product being formed on the semiconductor wafer 55 before it is placed into an electroplating apparatus 70. With the information provided by the vision system 60, the main electroplating control system 65 may set the various parameters that are to be used in the electroplating apparatus 70 to electroplate the metallization layer on the wafer 55.

In the illustrated system, the electroplating apparatus 70 is generally comprised of an electroplating chamber 75, a rotor assembly 80, and a stator assembly 85. The rotor assembly 80 supports the semiconductor wafer 55, a current control system 90, and a current thief assembly 95. The rotor assembly 80, current control system 90, and current thief assembly 95 are disposed for co-rotation with respect to the stator assembly 85. The chamber 75 houses an anode assembly 100 and contains the solution 105 used to electroplate the semiconductor wafer 55.

The stator assembly 85 supports the rotor assembly 80 and its associated components. A stator control system 110 may be disposed in fixed relationship with the stator assembly 85. The stator control system 110 may be in communication with the main electroplating control system 65 and may receive information relating to the identification of the particular type of semiconductor device that is being fabricated on the semiconductor wafer 55. The stator control system 110 further includes an electromagnetic radiation communications link 115 that is preferably used to communicate information to a corresponding electromagnetic radiation communications link 120 of the current control system 90 used by the current control system 90 to control current flow (and thus current density) at individual portions of the current thief assembly 95. A specific construction of the current thief assembly 95, the rotor assembly 80, the stator control system 110, and the current control system 90 is set forth in further detail below.

In operation, probes 120 make electrical contact with the semiconductor wafer 55. The semiconductor wafer 55 is then lowered into the solution 105 in minute steps by, for example, a stepper motor or the like until the lower surface of the semiconductor wafer 55 makes initial contact with the solution 105. Such initial contact may be sensed by, for example, detecting a current flow through the solution 105 as measured through the semiconductor wafer 55. Such detection may be implemented by the stator control system 110, the main electroplating control system 65, or the current control system 90. Preferably, however, the detection is implemented with the stator control system 110.

Once initial contact is made between the surface of the solution 105 and the lower surface of the semiconductor wafer 55, the wafer 55 is preferably raised from the solution 105 by a small distance. The surface tension of the solution 105 creates a meniscus that contacts the lower surface of the semiconductor wafer 55 that is to be plated. By using the properties of the meniscus, plating of the side portions of the wafer 55 is inhibited.

Once the desired meniscus has been formed at the plating surface, electroplating of the wafer may begin. Specific details of the actual electroplating operation are not particularly pertinent to the use or design of present invention and are accordingly omitted.

Figure 5A:
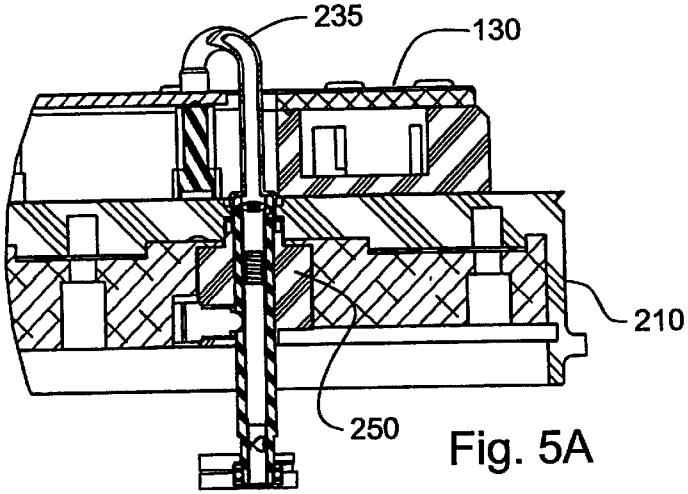
Figure 5B:
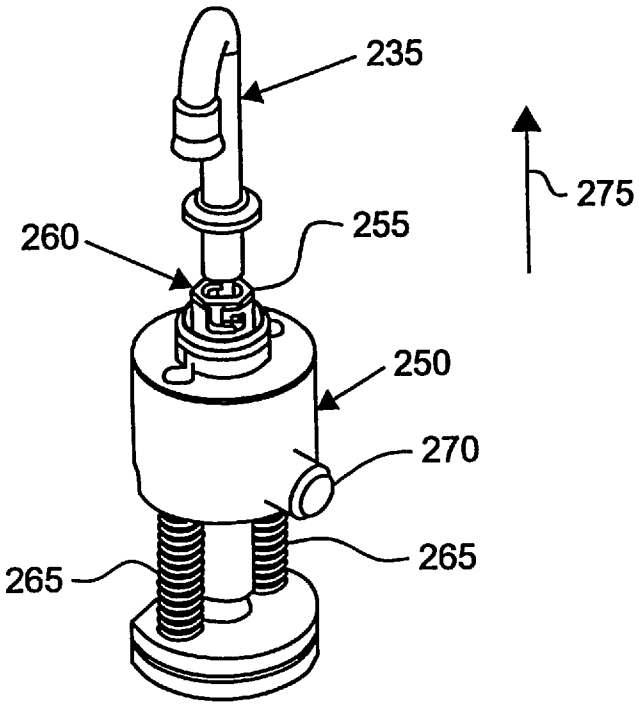
Figure 6:
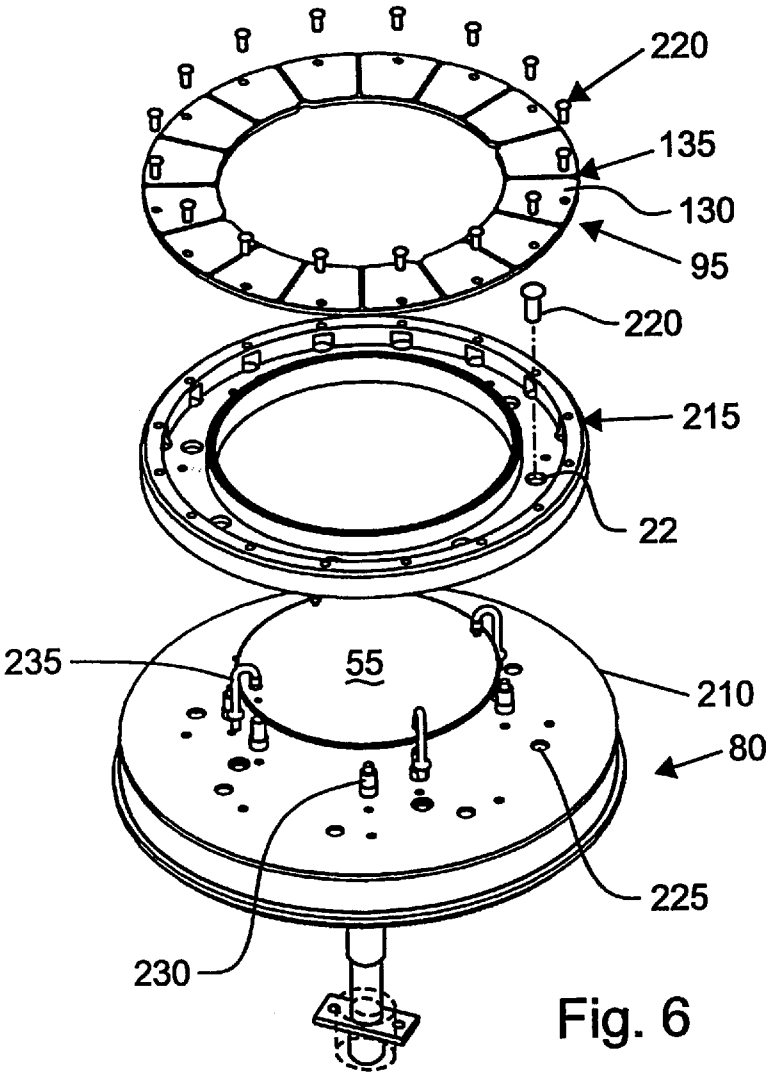
Figure 7:
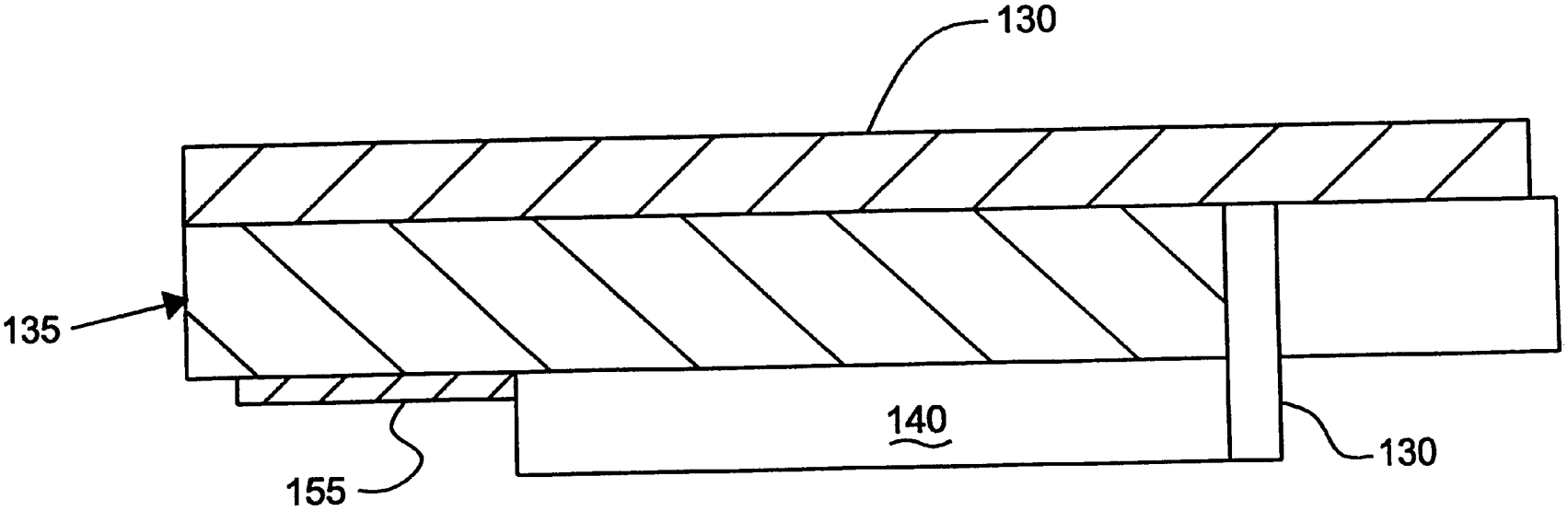
FIG. 7 is an exemplary cross-sectional view of a printed circuit board forming a part of the current thief of FIGS. 2–6 and showing the connection between a resistive element and its corresponding conductive segment.

FIGS. 2–7 illustrate the current thief assembly 95 and rotor assembly 80 as constructed in accordance with one embodiment of the present invention. As shown, the current thief assembly 95 comprises a plurality of conductive segments 130 that extend about the entire peripheral edge of the wafer 55. In the illustrated embodiment, the conductive segments 130 are formed on a printed circuit board 135. Each segment 130 is associated with a respective resistive element 140 as shown in FIG. 7. In the illustrated embodiment, the resistive elements 140 are disposed on the side of the printed circuit board opposite the segments 130. The resistive element 140 respectively associated with each segment may take on various forms. For example, the resistive element 140 may be a fixed or variable resistor. The resistive element 140 also may be constructed in the form of a plurality of fixed resistors that are selectively connected in circuit to one another in a parallel arrangement to obtain the desired resistance value associated with the respective segment. The switching of the individual resistors to or from the parallel circuit may ensue through a mechanical switch associated with each resistor, a removal conductive trace or wire associated with each resistor, or through an automatic connection of each resistor. Further details with respect to the automatic connection implementation are set forth below.

In each instance, the resistive element has a first lead 150 in electrical contact with the segment 130 and a second lead 155 for connection to cathode power. As such, the resistive elements 140 provide an electrical connection between the conductive segments 130 and, for example, a cathodic voltage reference 160 (See FIG. 1). In the disclosed embodiment, the voltage reference is a ground and is established through a brush connection between the rotor assembly 80 and the stator assembly 85 which is itself connected to ground. During electroplating of the semiconductor wafer 55, the resistive element 140 associated with each segment 130 controls current flow through the respective segment. The resistance value used for each of the resistive elements 140 is dependent on the current that the respective segment 130 must pass to ensure the uniformity of the plating over the portions of the wafer surface that are to be provided with the metallization layer. Such values may be obtained experimentally and may vary from segment to segment and from product type to product type.

Figure 8:
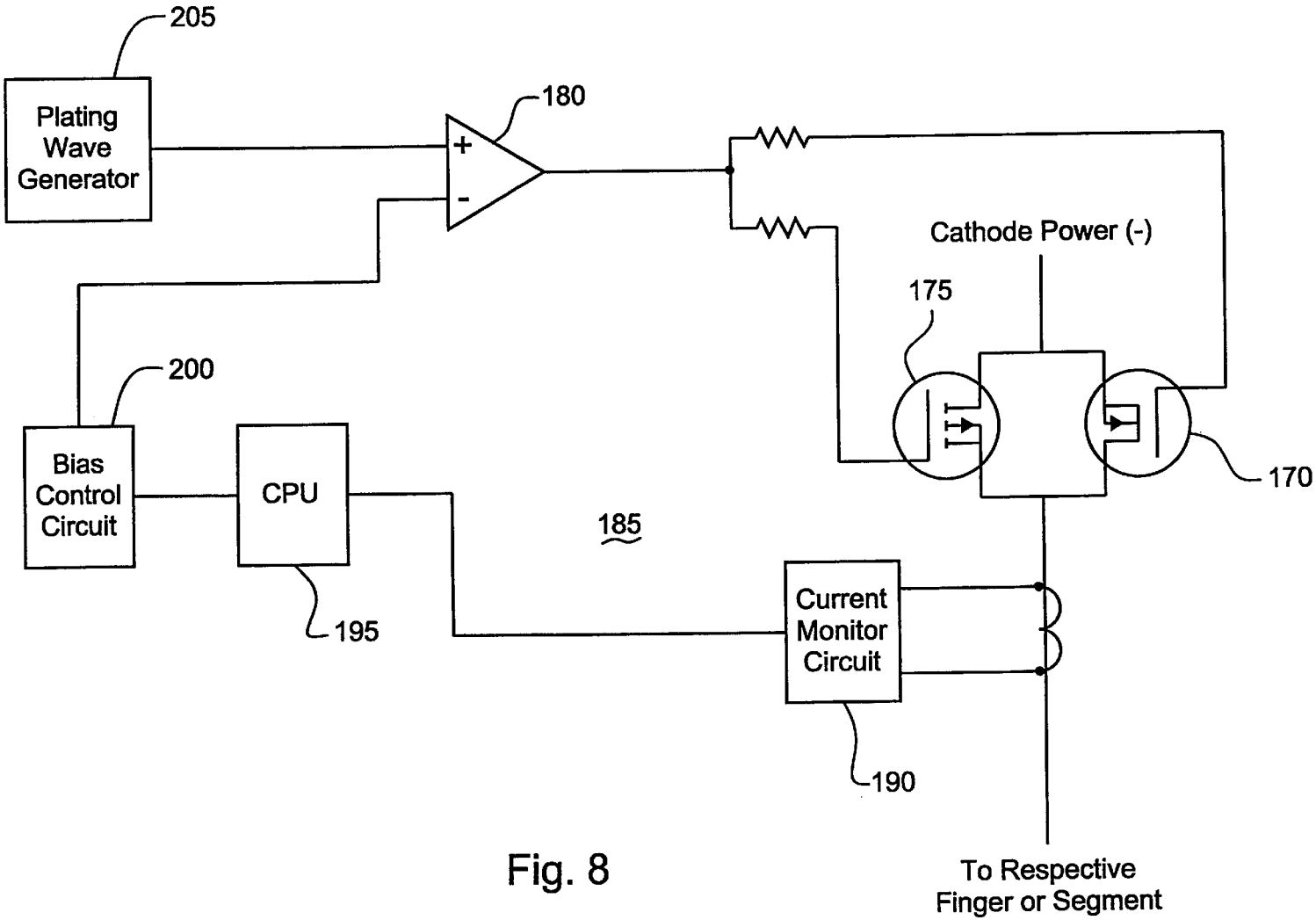
FIG. 8 illustrates one manner of implementing and controlling a resistive element connected to a respective segment.
Figure 9:
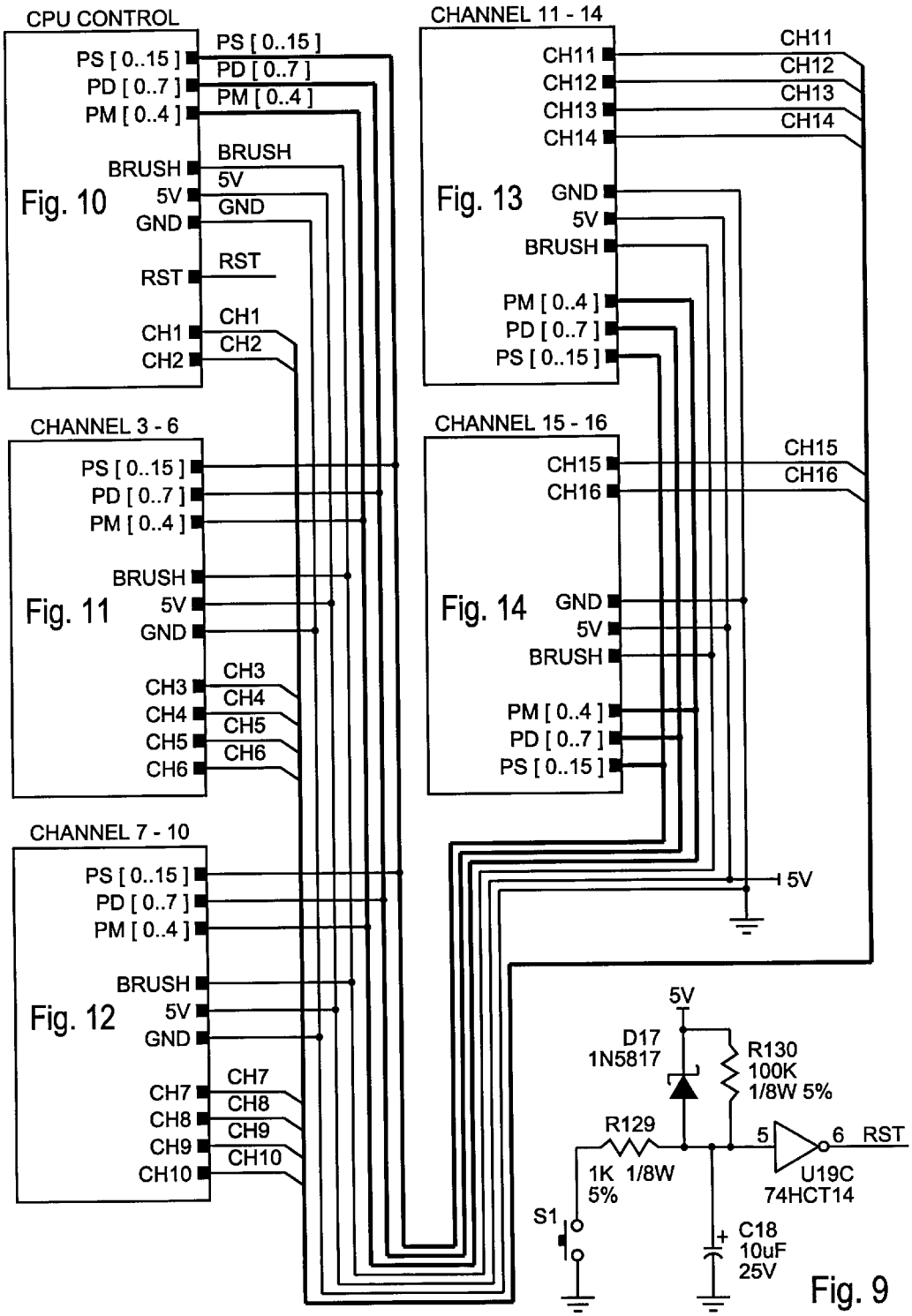
FIGS. 9–14A and B are schematic drawings illustrating one embodiment of a current control system that may be used in the system of FIGS. 1–7.
Figure 10A:
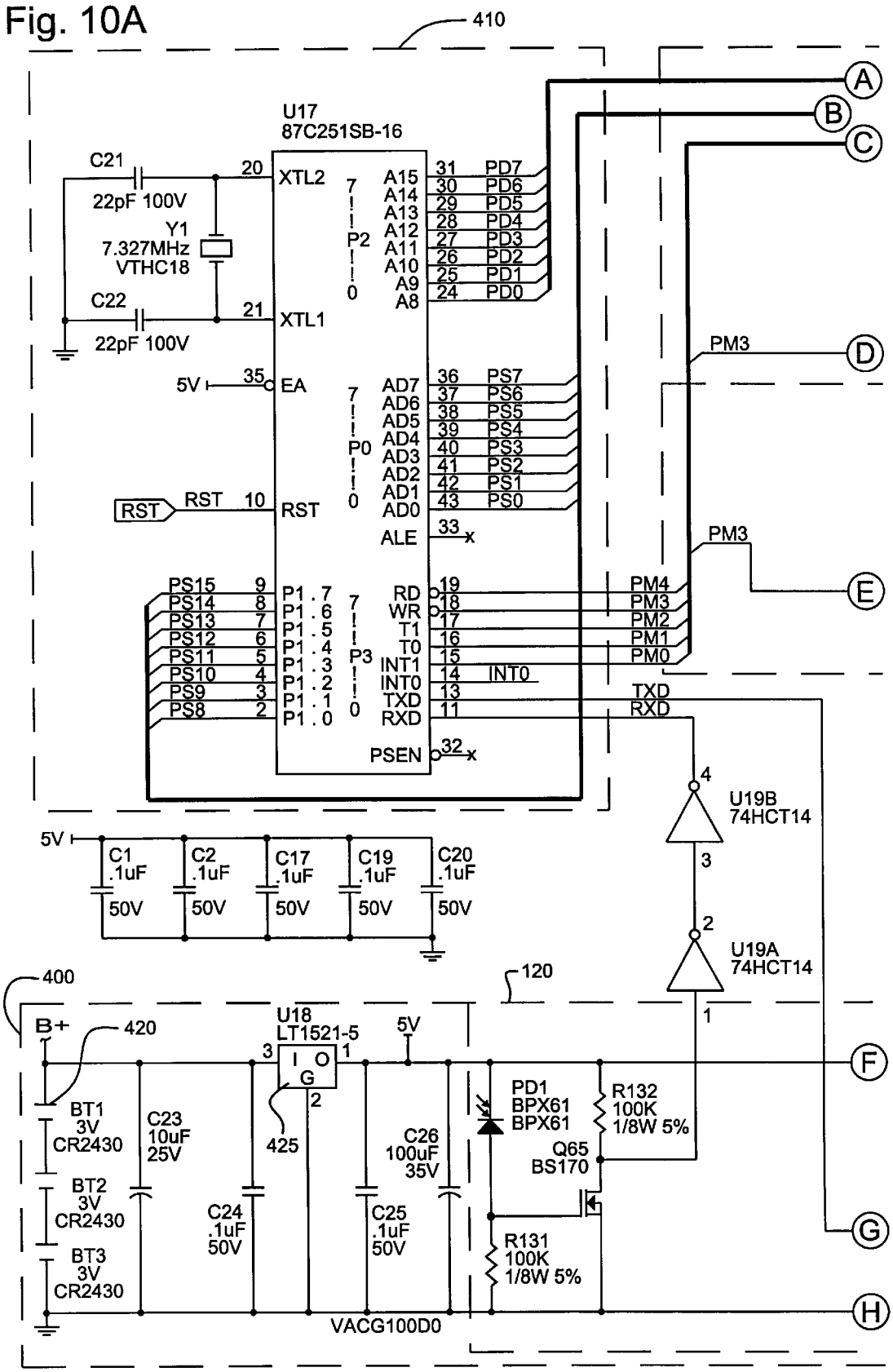
Figure 10B:
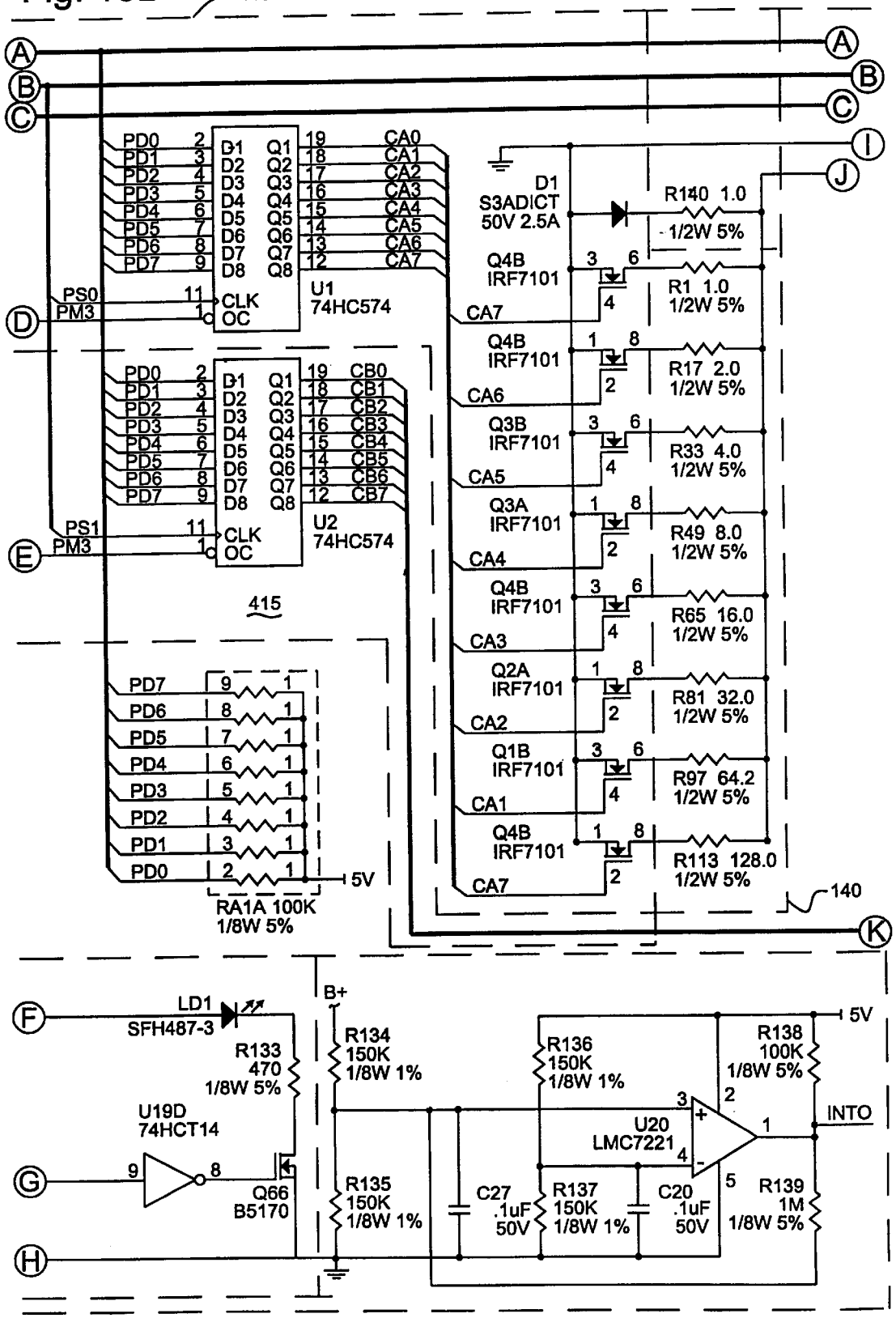
Figure 10C:
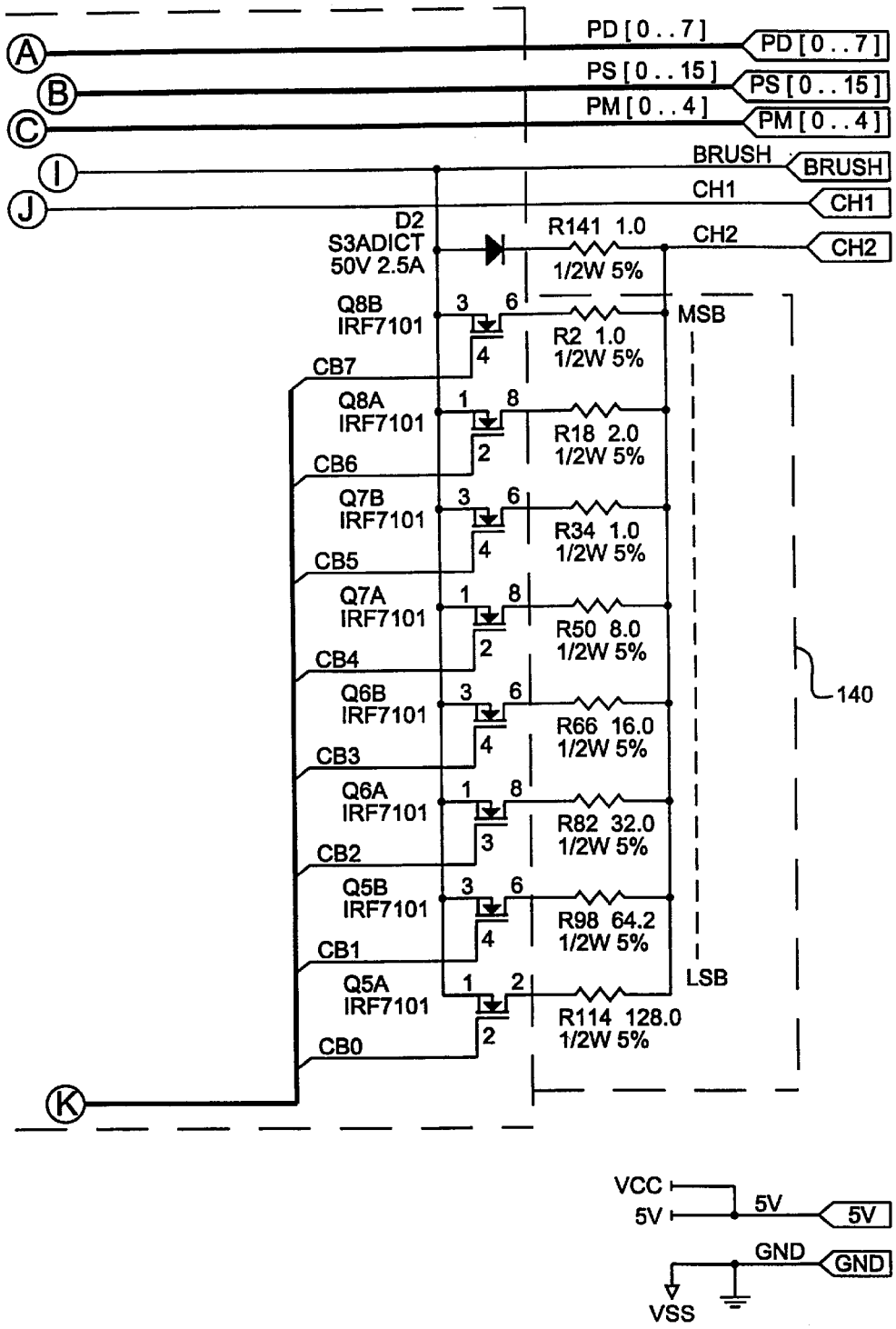
Figure 11A:
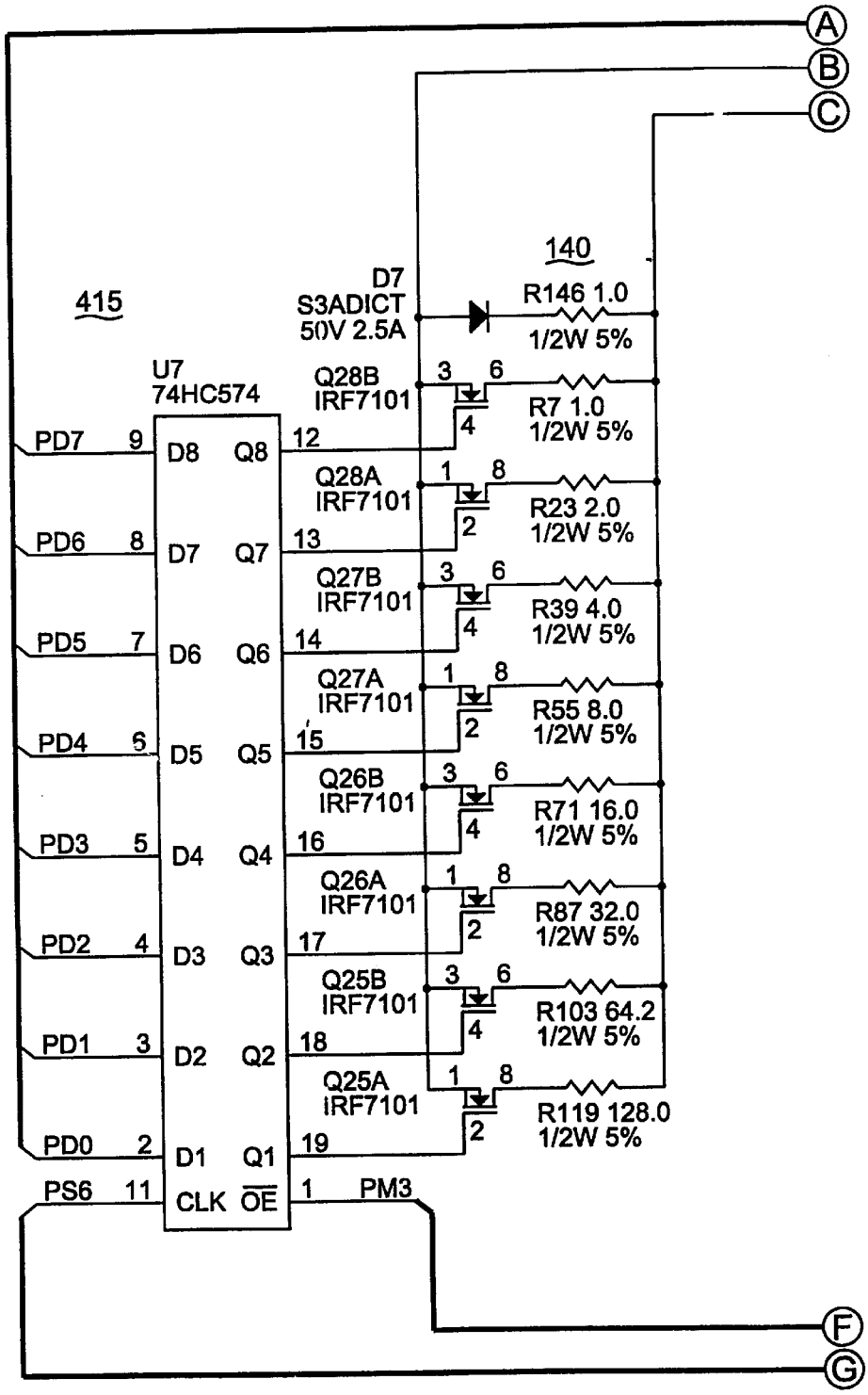
Figure 11A:
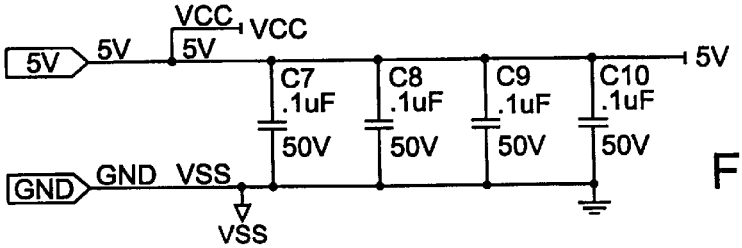
Figure 11B:
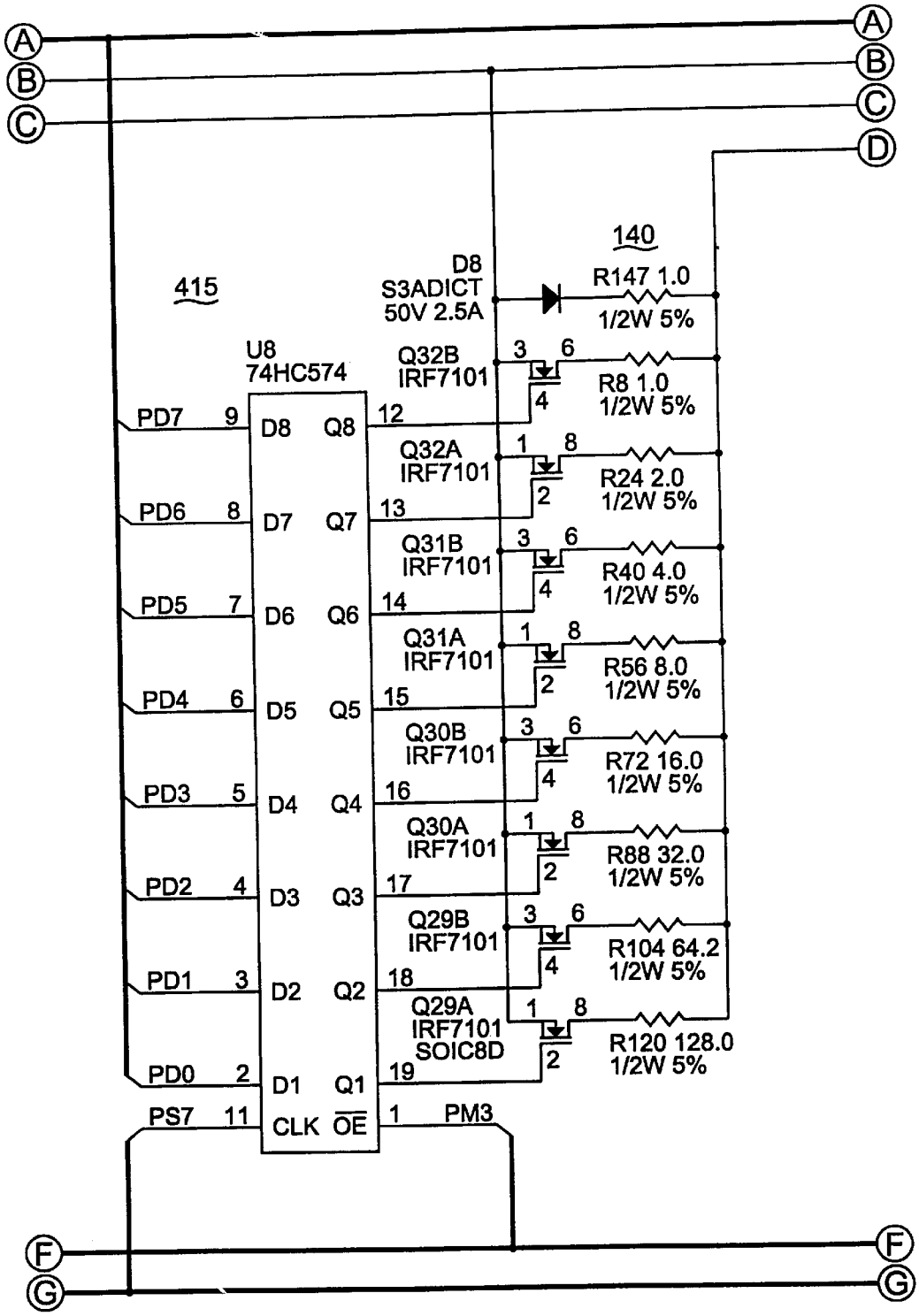
Figure 11C:
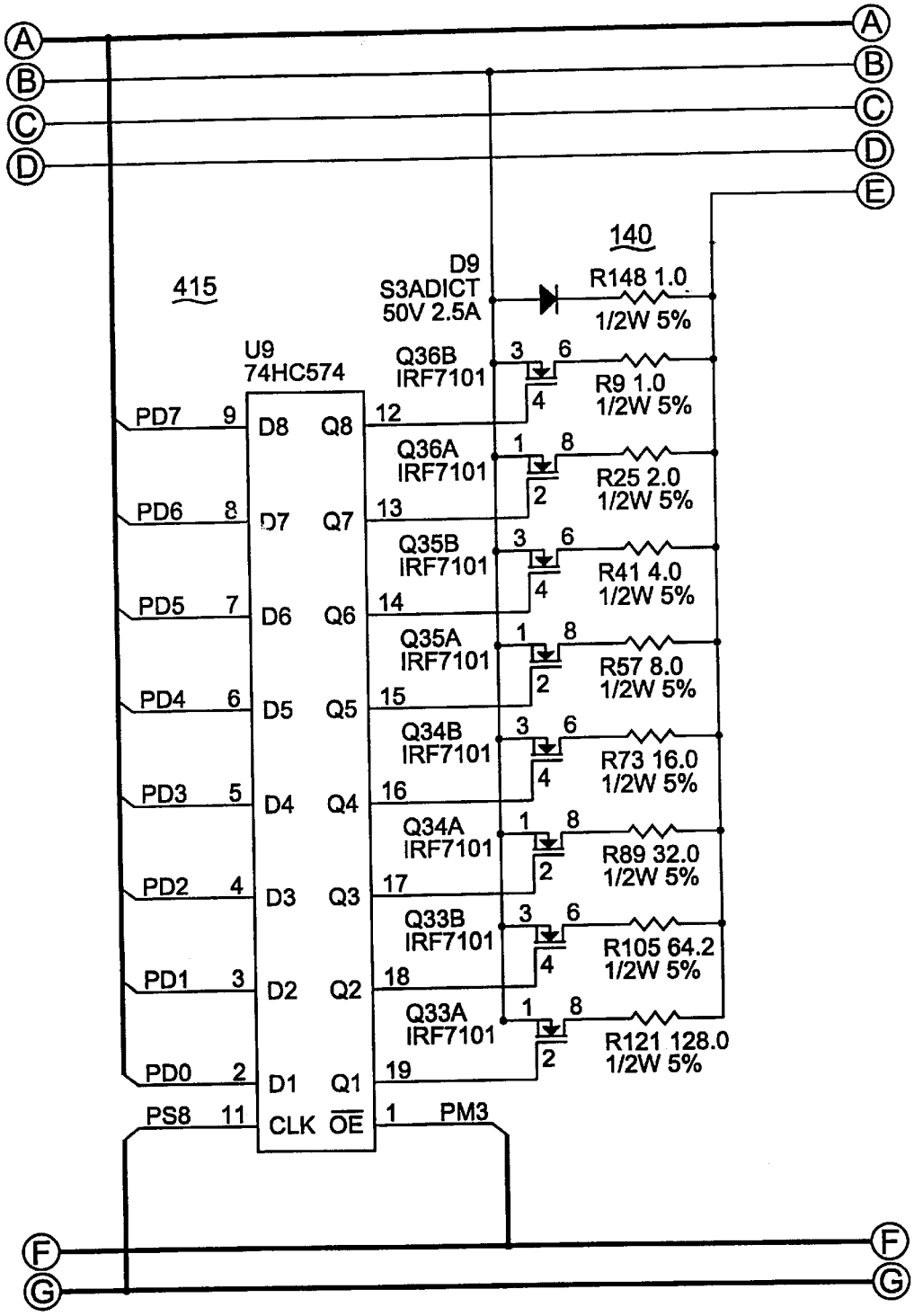
Figure 11D:
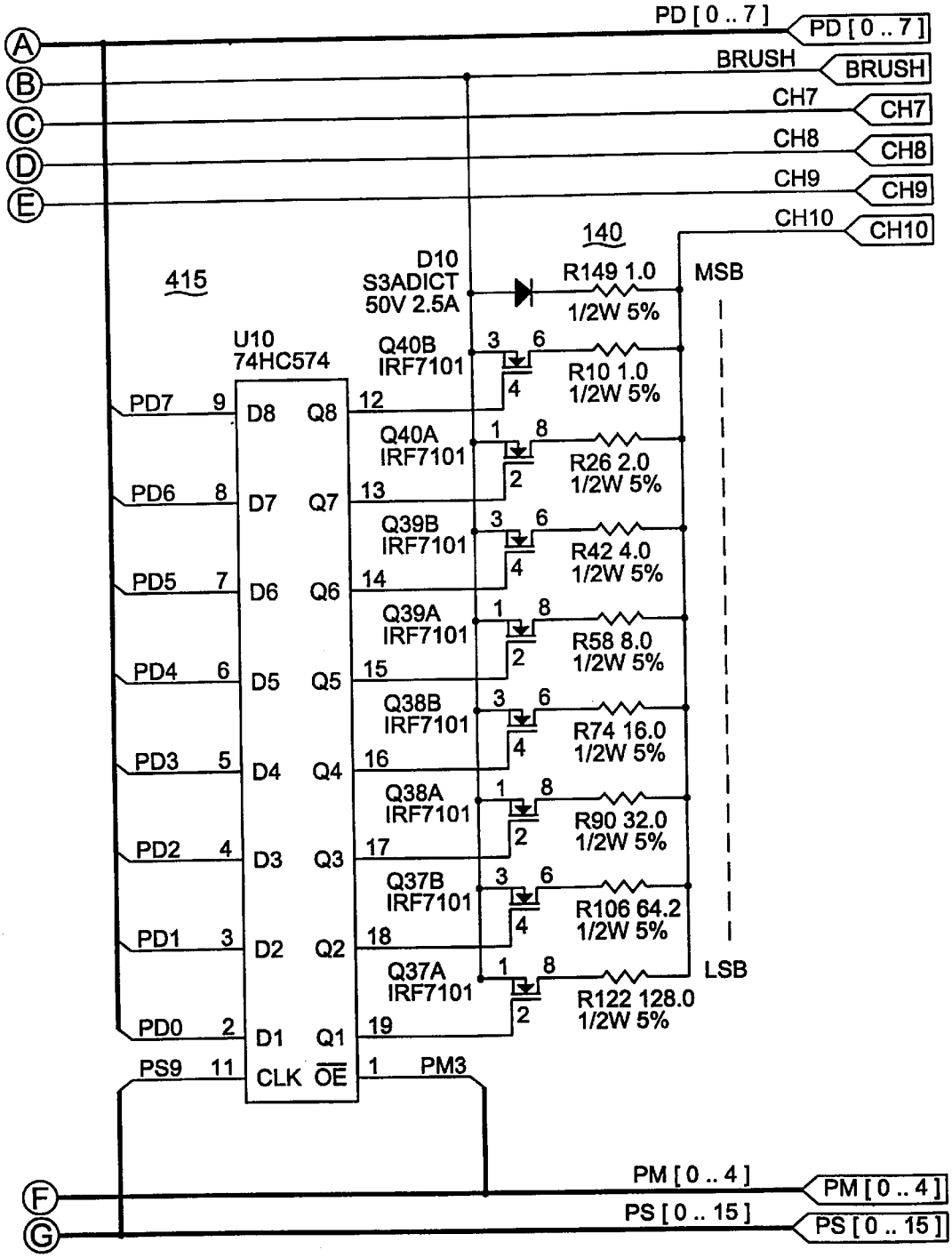
Figure 12A:
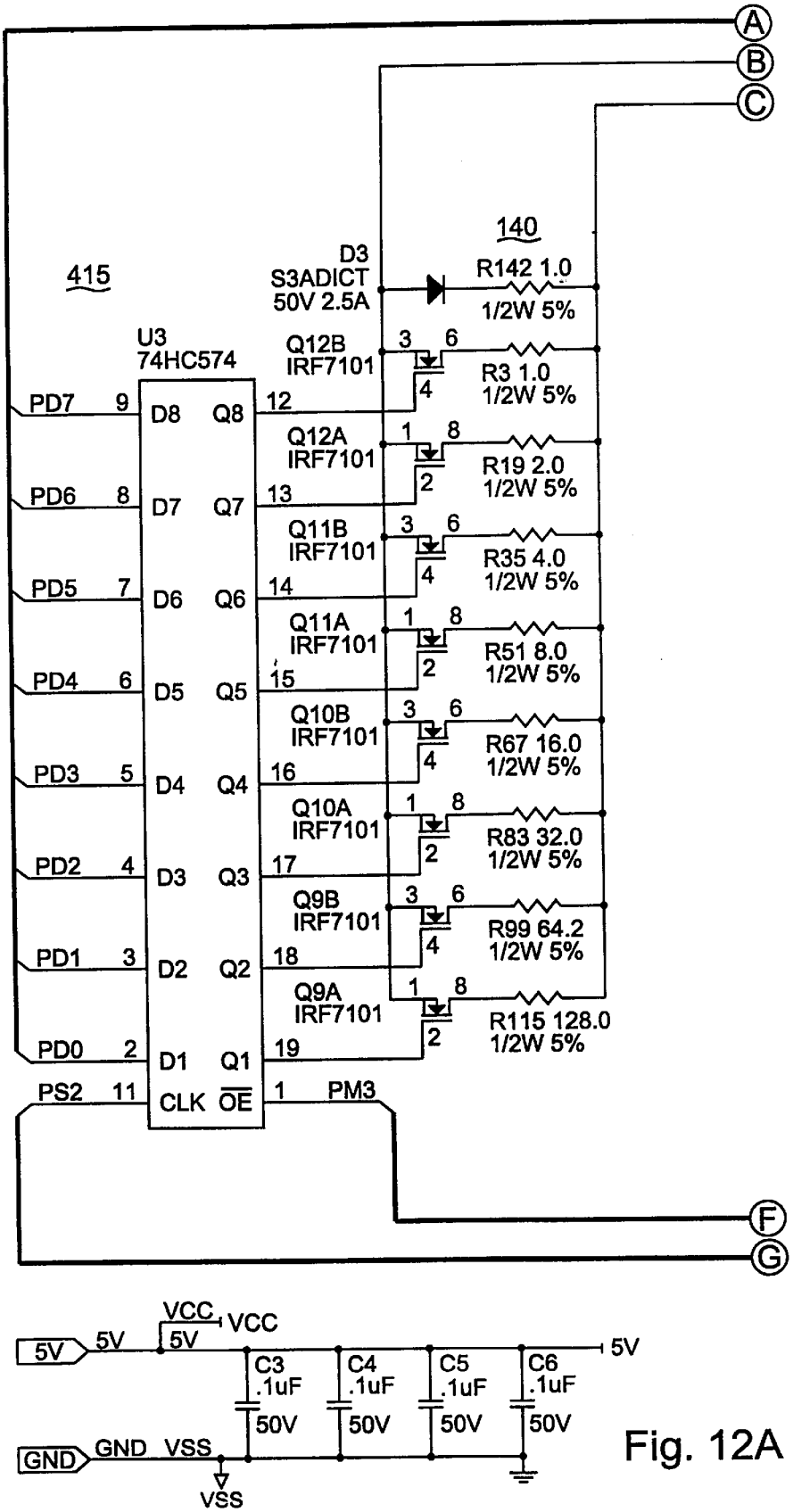
Figure 12B:
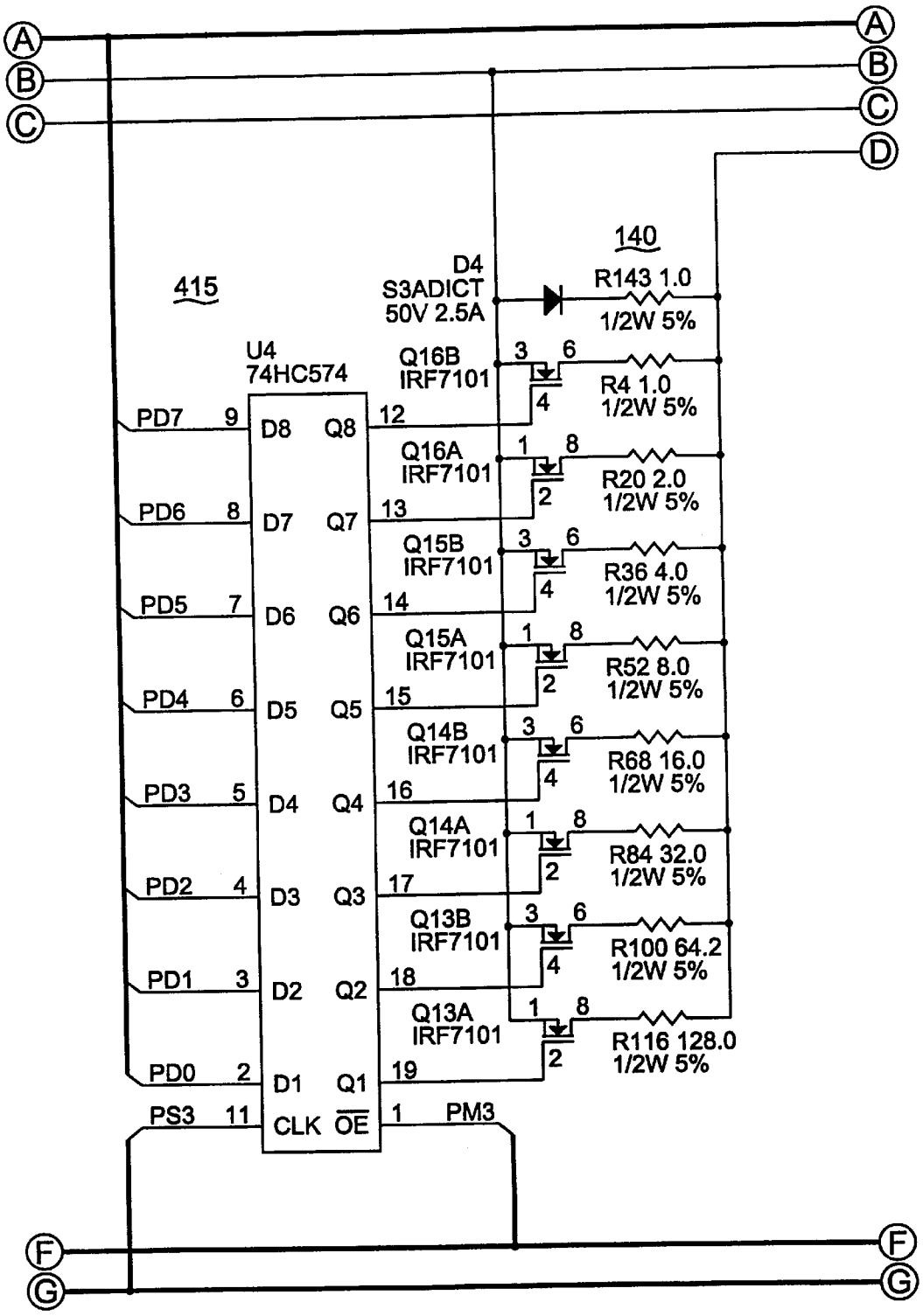
Figure 12C:
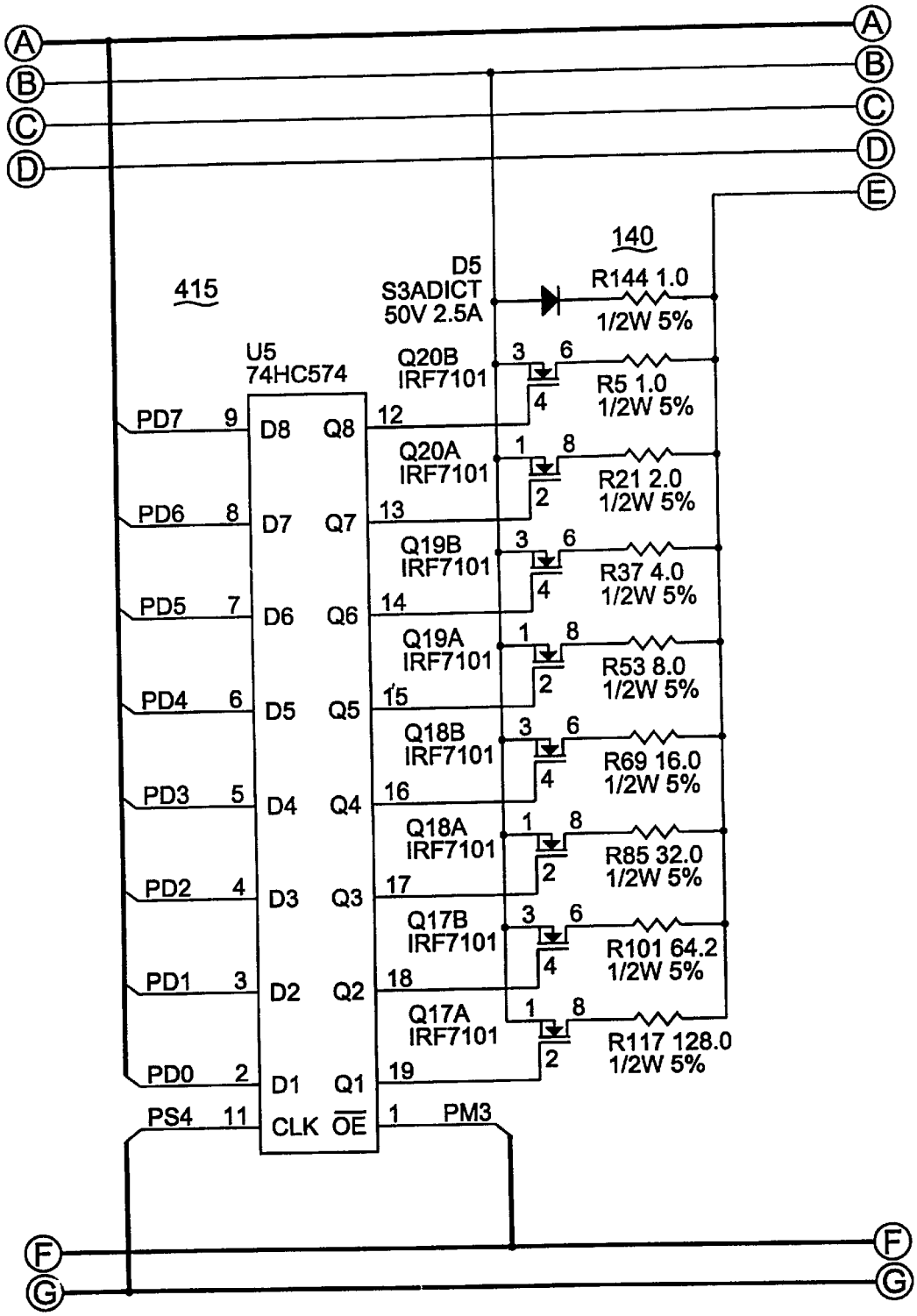
Figure 12D:
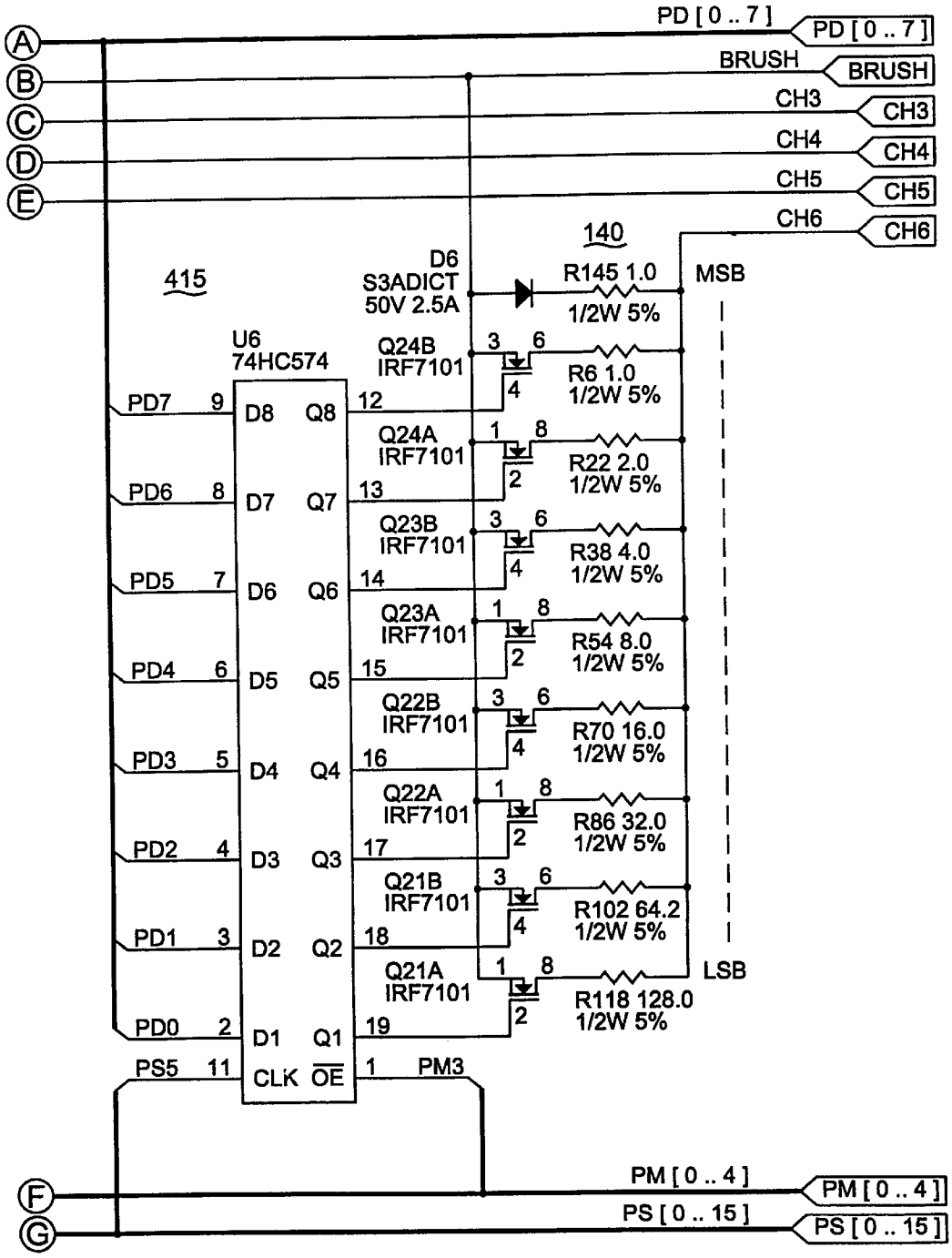
Figure 13A:
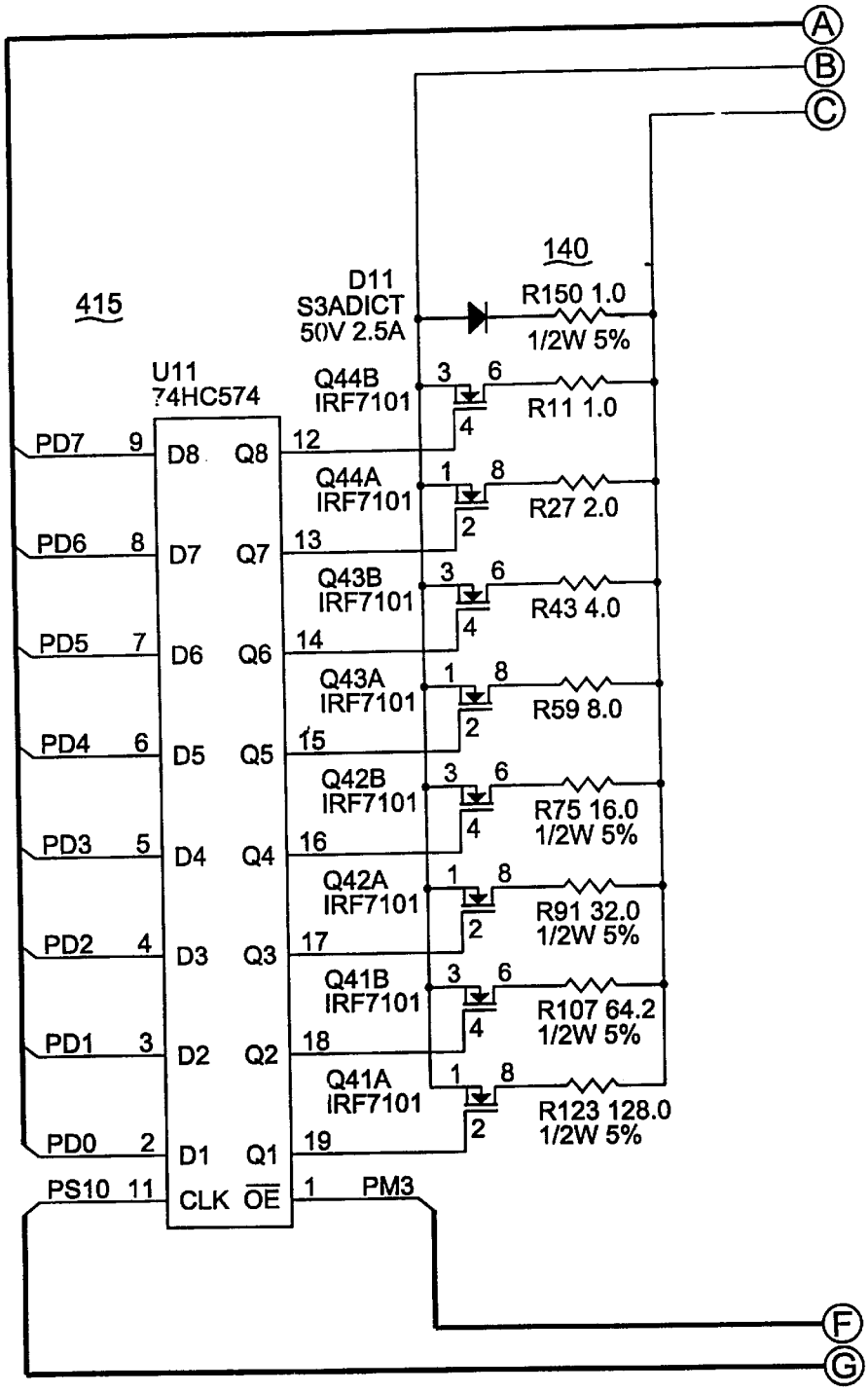
Figure 13A:
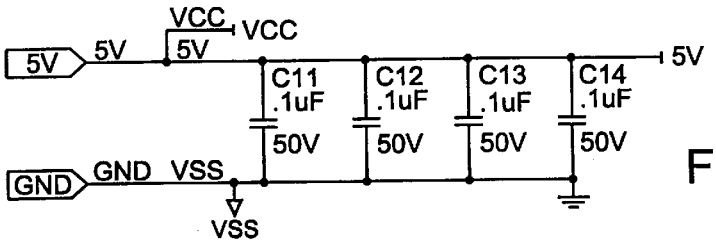
Figure 13B:
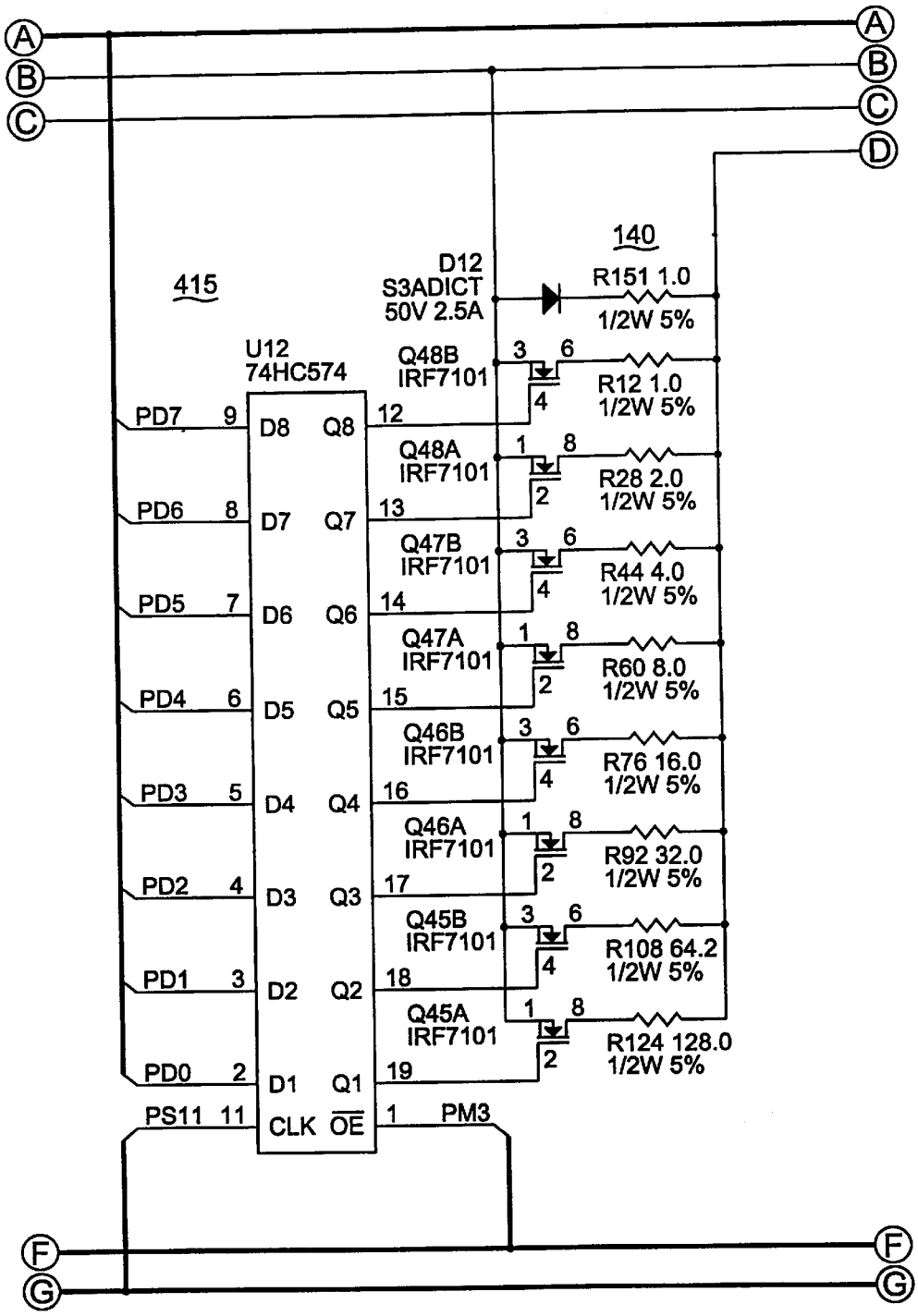
Figure 13C:
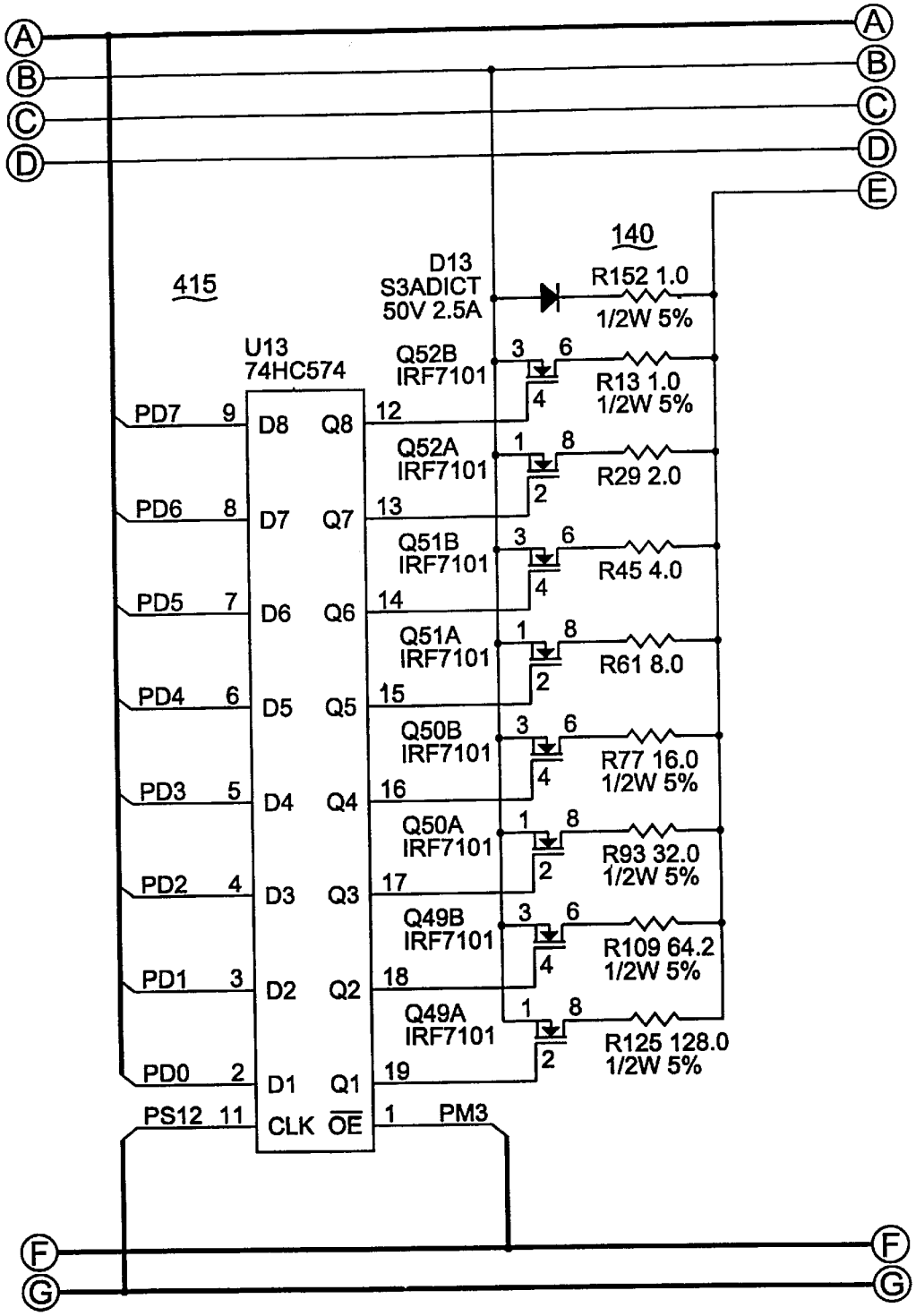
Figure 13D:
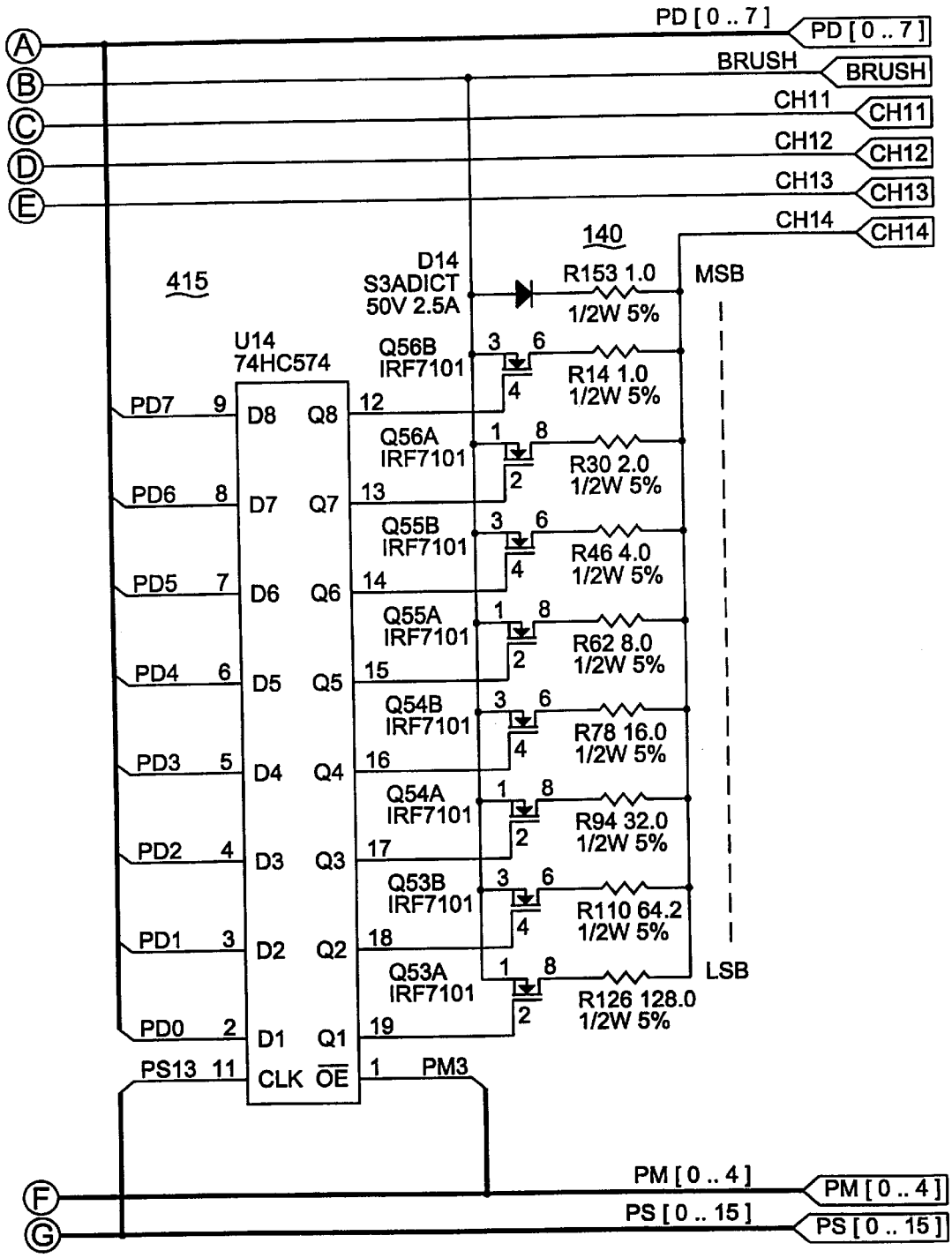
Figure 14A:
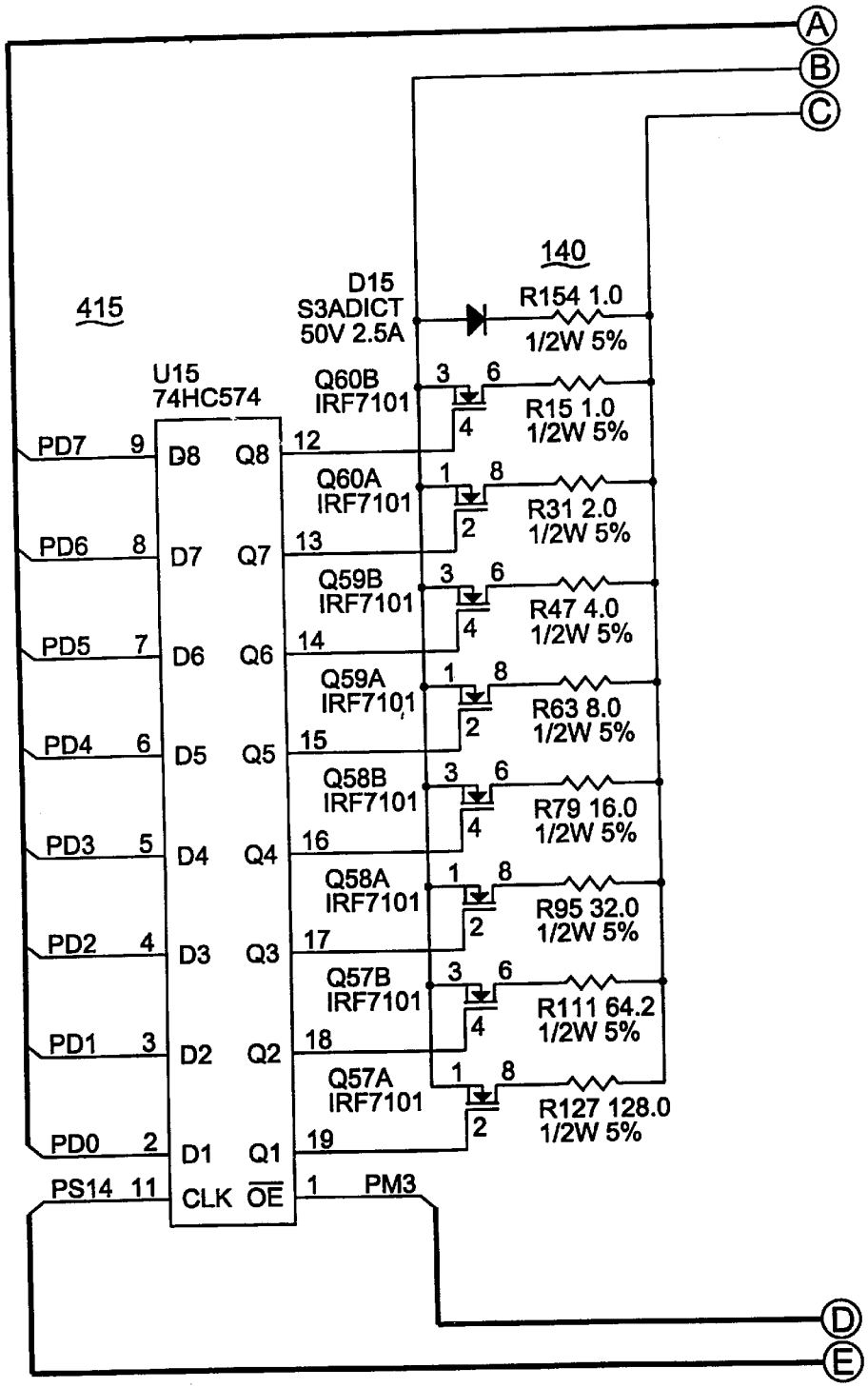
Figure 14A:
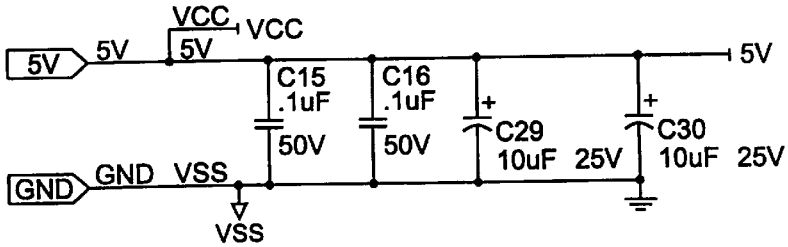
Figure 14B:
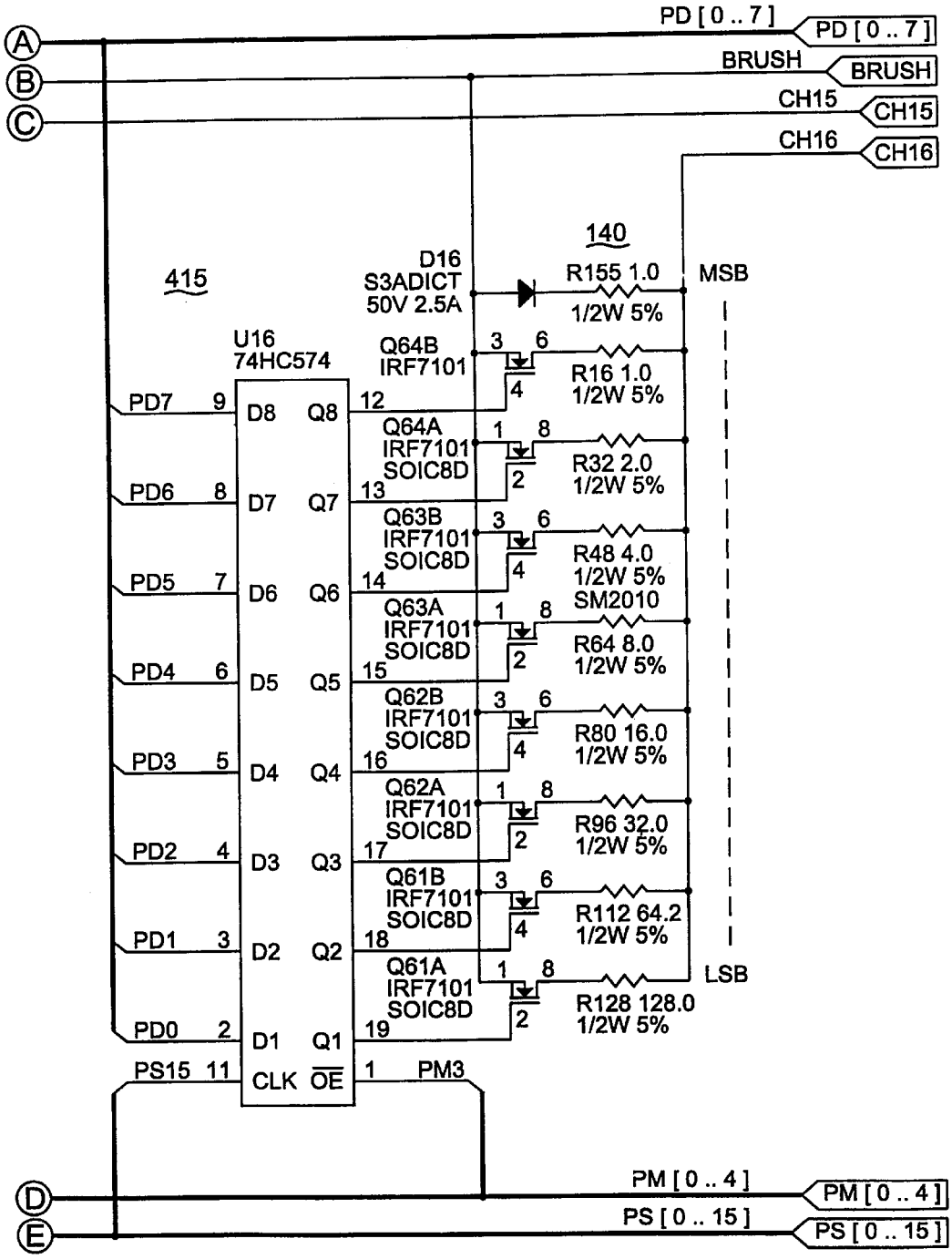

A still further resistive element that may be used to control current flow through each respective segment 130 is shown in FIG. 8. Here, the resistive element is comprised of a pair of FETs 170 and 175. The gate terminals of each FET 170 and 175 are connected to be driven by the output of a comparator 180 which is part of the feed-forward portion of a feedback control system shown generally at 185. The source terminals of the FETs 170, 175 are connected to the cathode power while the drain terminals of the FETs are connected to a respective segment (or, as will be set forth below, a respective finger).

In the feedback system 185, a current monitor circuit 190 monitors the current flowing through the respective segment 130 and provides a signal indicative of the magnitude of the current to a central processing unit 195. The control processing unit 195, in turn, provides a feedback signal to a bias control circuit 200 that generates an output voltage therefrom to the inputs of comparator 180. Comparator 180 uses the signal from the bias control circuit 200 and, further, from a plating waveform generator 205 to generate the drive signal to the gate terminals of the FETs 170 and 175.

The central processing unit 195 is programmed to set the individual set-point current values for each of the segments 130 of the current thief assembly 95. If the measured current exceeds the set-point current value, the control processing unit 195 sends a signal to the bias control circuit 200 that will ultimately control the drive voltage to the FETs 170, 175 so as to reduce the current flow back to the set-point. Similarly, if the measured current falls below the set-point current value, the control processing unit 195 sends a signal to the bias control circuit 200 that will ultimately control the drive voltage to the FETs 170, 175 so as to increase the current flow back to the set-point for the respective segment.

The current thief assembly 95 is disposed for co-rotation with the rotor assembly 80. With reference to FIG. 6, the printed circuit board 135 is attached on a surface of a hub 210 of the rotor assembly 80. The board 135 is spaced the hub 210 by an insulating thief spacer 215 and secured to the spacer 215 using a plurality of fasteners 220. The spacer 215, in turn, is secured to the hub 210 of the rotor assembly 80 using fasteners 220 that extend through securement apertures 225 of both the spacer 215 and hub 210.

The hub 210 of the rotor assembly 80 is also provided with a plurality of support members for securing the wafer 55 to the rotor assembly 80 during the electroplating process. In the illustrated embodiment, the support members comprise insulating projections 230 that extend from the hub surface and engage a rear side of the wafer 55 and, further, a plurality of conductive fingers 235. The fingers 235 are in the form of j-hooks and contact the surface of the wafer that is to be plated. Preferably, each of the fingers 235 may be respectively associated with a resistive element 140 such as described above in connection with the segments 130 of the current thief assembly 95. The current flow through each of the fingers 235 and its respective section of the wafer 55 may thus be controlled. Still further, conductive portions of the fingers 235 that contact the electroplating solution during the electroplating process may also perform a current thieving function and, accordingly, control current density in the area of the fingers. To this end, the amount of exposed metal on each of the fingers 235 may vary from system to system depending on the amount of current thieving required, if any, of the individual fingers 235.

The conductive fingers 230 may be part of a finger assembly 240 such as the one illustrated in FIGS. 5A and 5B. As shown, the finger assembly 240 is comprised of an actuator 250 including a piston rod 255. The piston rod 255 engages the finger 235 at a removable interconnect portion 260 for ease of removal and replacement of the finger 235. Further, the actuator 255 is biased by springs 265 so as to urge the fingers against the wafer 55 as shown in FIG. 5. The fingers 235 may be urged to release the wafer 55 by applying a pressurized gas to the actuator 250 through inlet 270. Application of the pressurized gas urges the fingers 235 in the direction shown by arrow 275 of FIG. 5 thereby facilitating removal of the wafer 55 from the rotor assembly 80.

Figure 4:
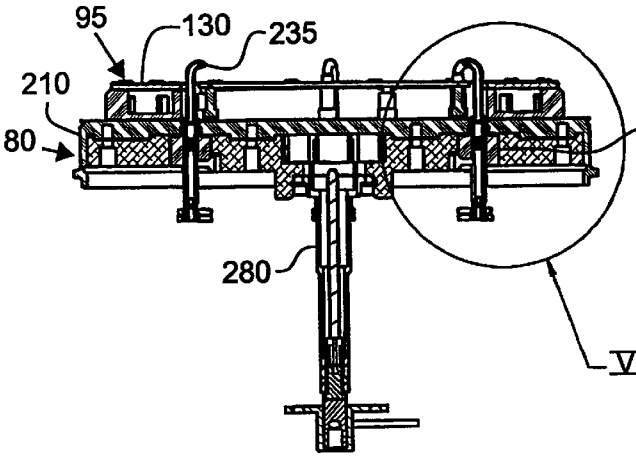

As shown in FIG. 4, the hub 210 is connected to an axial rod assembly 280 that extends into rotational engagement with respect to the stator assembly 85. The axial rod 280 is coaxial with the axis of rotation of the rotor assembly 80. The brush connection used to establish the reference voltage level with respect to the anode assembly 100 used in the electroplating process may be established through the axial rod.

FIGS. 9–14 illustrate one embodiment of a control system that may be used to vary the resistance values of the resistive elements 140 thereby controlling the current flow through the conductive segments 130 and, optionally, the conductive fingers 235. Generally stated, the control system comprises a power supply circuit 400 to supply power for the control system, an electromagnetic communications link 120 for communicating with the stator control system 110, a processor circuit 410 for executing the programmed operations of the control system, the resistive elements 140 for controlling the current flow through the individual segments 130 and, optionally, fingers 235, and a resistive element interface 415 providing an interface between the processor 410 and the resistive elements 140.

The power supply circuit 400 preferably uses batteries 420 as its power source. The negative side of the battery supply is referenced to the brush contact (ground). Three 3 V lithium coin cells are used to provide 9 V to the input of a LT1521 5 VDC regulator 425. This ensures 3.5 volts of compliance. The op-amp U3 and corresponding circuitry monitors the output of the 5 VDC regulator LT1521 and provides an interrupt to the 87251 processor U17 when the batteries require replacement.

The processor U17 is preferably an 87251 microcontroller and controls communication with the control system. One of the communications links is the electromagnetic radiation link 120 which is preferably implemented as an infra-red communications link that provides a communications interface with a corresponding infra-red communications link in the stator control system 115.

When the rotor assembly 80 is in a "home position" with respect to the stator assembly 85, the processor U17 may receive data over the link 120 from the stator control system 110. The data transmitted to the control system over the link 120 of the disclosed system includes sixteen/twenty, 8-bit channel data (see below). The processor U17 controls the return of an ack/checksum and an additional battery status byte to the stator control system 110. The data received by the control system is stored by the processor U17 in battery backed RAM.

Once the data is verified, the processor U17 controls the resistive element interface 415 to select the proper resistance value for each of the resistive elements 140. In the illustrated embodiment, the resistive elements 140 can be divided into individual resistive channels 1–20 respectively associated with each of the conductive segments 130 and, optionally, each of the conductive fingers 235. Since the current thief assembly 95 of the illustrated embodiment uses sixteen segments 130 and there are four conductive fingers 235 that are used, either sixteen or twenty resistive channels may be employed.

As shown with respect to the exemplary resistive channel 1, each resistive channel 140 is comprised of a plurality of fixed resistors that may be selectively connected in parallel with one another to alter the effective resistance value of the channel. Eight fixed resistors are used in each channel of the disclosed system.

Each channel is respectively associated with an octal latch, shown here as U1 for channel 1. The output of each data bit of the octal latch U1 is connected to drive a respective MOSFET Q1A–Q4B that has its source connected to a respective fixed resistor of the channel.

The processor U17 uses its Port 2 as a data bus to communicate resistor selection data to the octal latches of the resistive element interface 415. Ports 1 and 0 of the processor U17 provides the requisite clock and strobe signals to the latches. After the requisite data has been communicated to the octal latches, the processor U17 preferably enters a sleep mode from which it awakes only during a reset of the system or when the stator control system 110 transmits further information through the infra-red link.

Based on the data communicated to each of the octal latches, various selected ones of the MOSFETs for the respective channel are driven to effectively connect corresponding fixed resistors in parallel with one another and effectively in series with the respective segment 130 or finger 235. The resistance values of the fixed resistors for a given channel are preferably weighted to provide a wide range of total resistance values for the channel while also allowing the resistance values to be controlled with in relatively fine resistance value steps.

The foregoing control system is preferably mounted for co-rotation with the rotor assembly 80. Preferably, the control system is mounted in the hub 210 in a location in which it is not exposed to the electroplating solution 105.

Figure 15A:
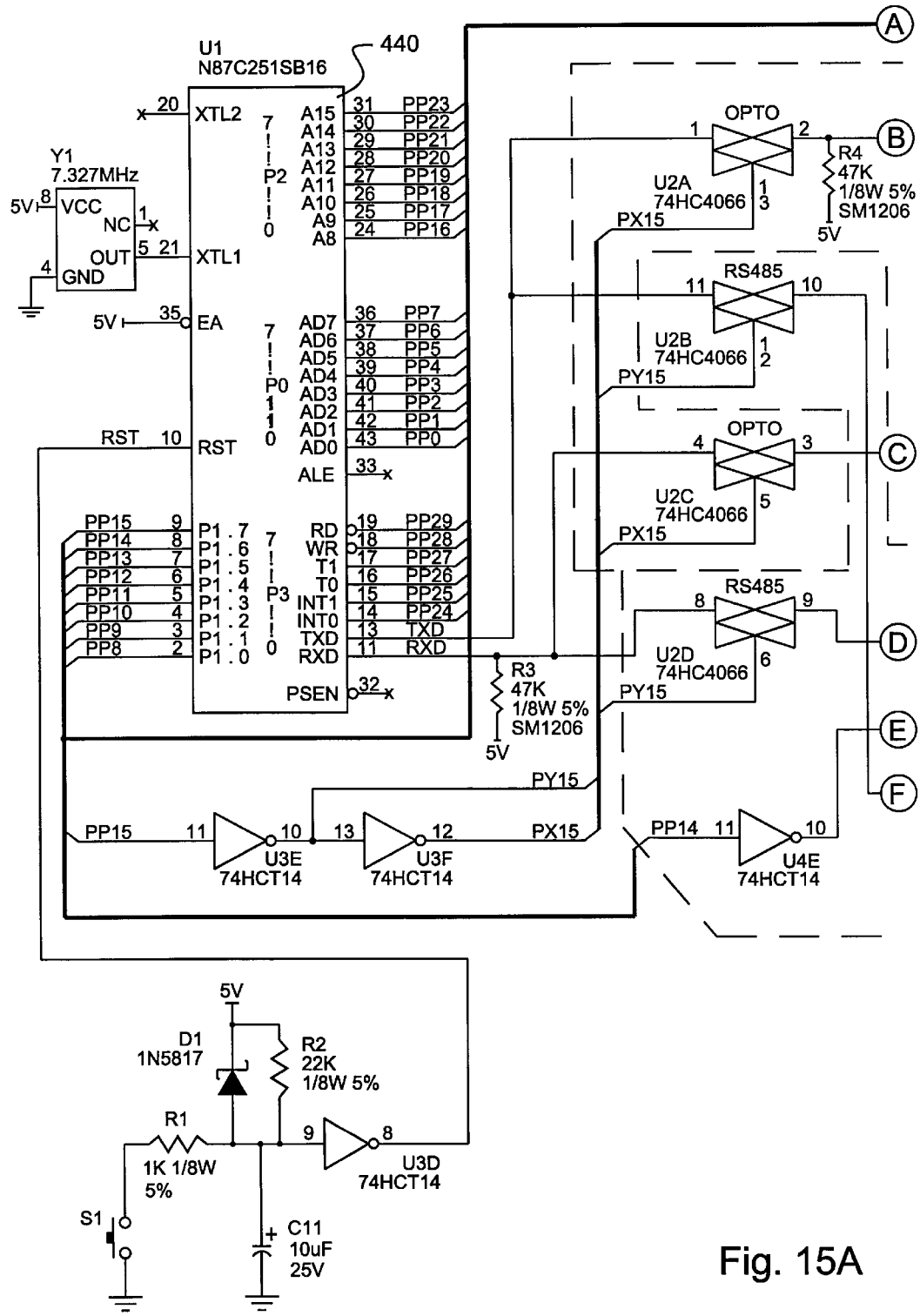
FIGS. 15A and B and 16 are schematic drawings illustrating one embodiment of a stator control system that may be used in the system of FIGS. 1–7.
Figure 15B:
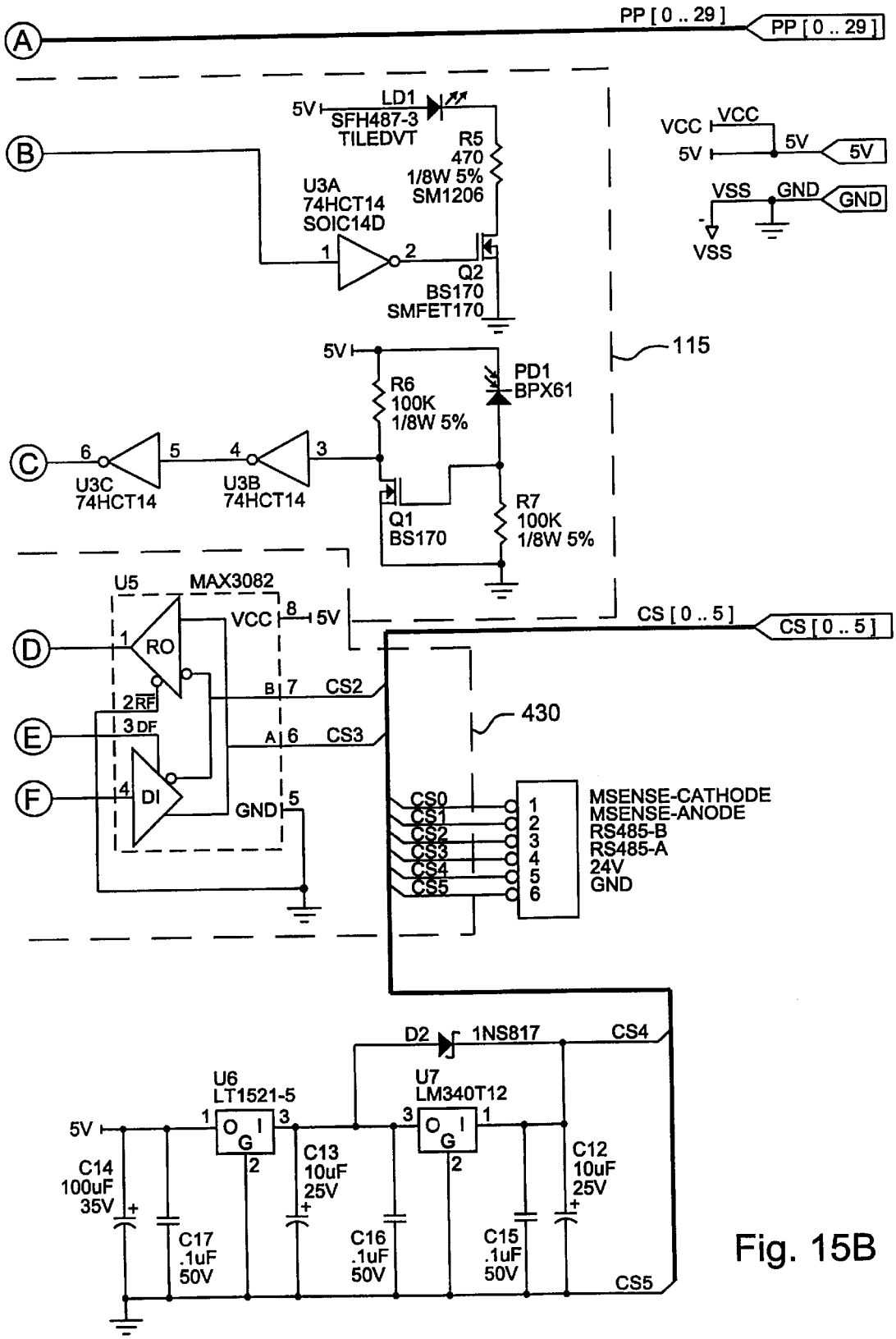
Figure 16:
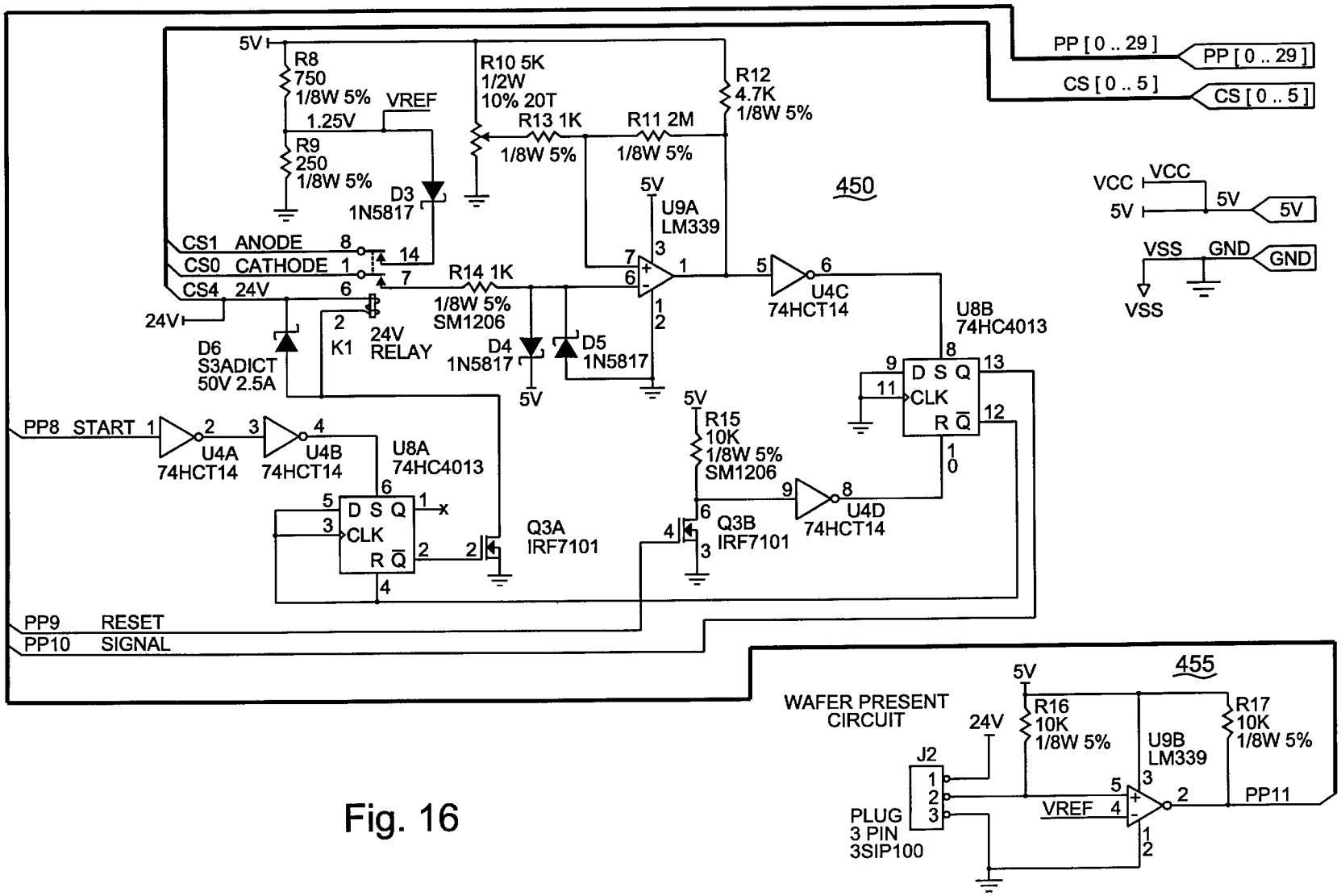

One embodiment of the stator control system 110 is shown in FIGS. 15–16. The stator control system 110 includes an 87251 processor 440 that contains the programming for the stator control system operation. The primary function of the stator control system 110 is to receive programming information from the main control system 65 over an RS485 half duplex multi-drop communications link 430. The programming information of the disclosed embodiment includes the sixteen/twenty, eight bit values used to drive the MOSFETs of the resistive element interface 415. Data transmitted from the stator control system 110 to the main control system 65 includes: an ack/checksum OK and an additional byte containing a product detection bit, a meniscus sense bit, and a rotor control system battery status bit.

Communications between the current control system 90 and the stator control system 110 should be kept to a minimum to conserve battery power in the rotor control system. Due to the gain limitations of the micro-power characteristics of the integrated circuits used in the current control system 90, the baud rate used for the communications should be maintained between 600 baud and 1.2 K baud. The static RAM of the rotor control system is non-volatile. As such, the channel resistance programming values are stored so long as there is power in the batteries. Communications between the stator control system 110 and the current control system 90 need only take place when the batteries are replaced or when different plating characteristics are necessary.

The stator control system 110 includes an on-board watchdog timer which is software enabled/disable. The watchdog timer is enabled after power-on reset and register initialization. One of the on-board timers also provides a timer for controller operation and I/O debounce routines.

The stator control system 110 also includes a meniscus sense circuit 450 as shown on FIG. 16. Just prior to product plating, a start signal at PP8 from the processor 440 enables relay K1. In response, the signal at PP10 output from the meniscus sense circuit 450 is provided to the processor 440 when the product contacts the plating solution. This latching signal causes the control system to stop downward motion and retract, for example, 0.050 in. to provide the meniscus pull described above. Mechanisms for lowering and raising the semiconductor wafer 55 may be constructed in effectively the same manner as such mechanisms are implemented on the Equinox® semiconductor processing machine available from Semitool, Inc., of Kalispell, Mont.

The stator control system 110 also provides a wafer sensor interface 455 at J2. The external product sensor (not illustrated) may be, for example, an open collector optical sensor such as one available from Sunx.

On initialization of the control system 110, the processor 440 preferably stores $FF to all of the ports. The following table lists the port assignments for the processor.

TABLE 1

| PORT | FUNCTIONALITY |
|---|---|
| P0 [0 . . . 7] | NOT USED |
| P1.0 #P8) | MENISCUS SENSE START/ STOP |
| P1.1 (PP9) | MENISCUS SENSE RESET |
| P1.2 (PP10) | MENISCUS SENSE SIGNAL |
| P1.3 (PP11) | WAFER/PRODUCT SENSE |
| P1.4 (PP12) | NOT USED |
| P1.5 (PP13) | NOT USED |
| P1.6 (PP14) | RS-485 TRANSMITTER ENABLE |
| P1.7 (PP15) | RS-485/OPTICAL LINK SELECT |
| P2 [0 . . . 7] | NOT USED |
| P3.0 (R×D) | RECEIVER DATA |
| P3.1 (T×D) | TRANSMITTER DATA |
| P3.2 (PP24) THROUGH P3.7 (PP29) | NOT USED |

Figure 17:
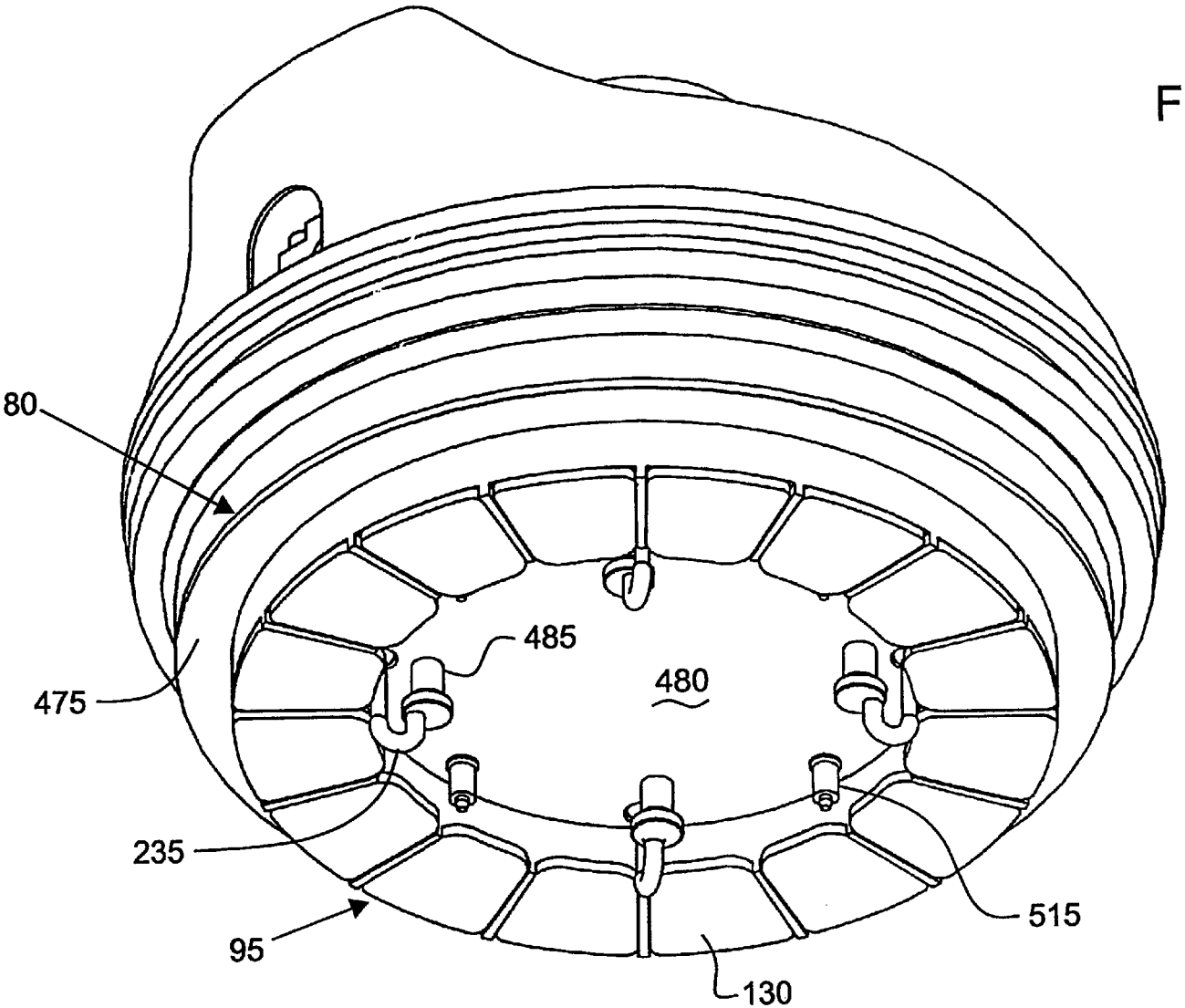
FIGS. 17 and 18 illustrate a further embodiment of the present invention.

A further embodiment of the current thief 95 and corresponding rotor assembly 80 is set forth in FIG. 17. In the illustrated embodiment, the segments 130 are preferably formed from stainless steel and are secured to a polymer base 475 that, in turn, is secured to the hub 210. Each of the segments 130 projects beyond the inner parameter of the base 475 toward the wafer support area, shown generally at 480.

In the illustrated embodiment, each finger 235 is associated with a corresponding insulating anvil support 485. As such, the wafer 55 is gripped between the end of conductive fingers 235 and the respective anvil supports 485 to secure the wafer for rotation of the rotor assembly 80 during the electroplating process.

The circuits for the current control system 90 are disposed on, for example, printed circuit board 500. Electrical connection between each of the segments 130 and the corresponding resistive element 140 on board 500 is facilitated through the use of a plurality of stand-offs 490 . Each stand-off 490 extends from a respective connection to one of the resistive elements 140 on the printed circuit board 500 through the base 475 and into electrical engagement with a respective one of the conductive segments 130. The stand-offs 490 also function to secure the board 500, hub 210, and base 475 to one another.

The entire assembly 510 may be disposed for rotation or pivoting about a horizontal axis. In a first position shown in FIG. 18, the wafer is faced downward toward the plating solution for processing. In a second position, the entire assembly is inverter to expose the wafer to manipulation by, for example, mechanical arms or the like. To assist in removal of the wafer from the processing area 480, the assembly 510 is provided with a plurality of pneumatically actuated lifter mechanisms 515. When actuated, the lifter mechanisms 515 lift the wafer to a level beyond the current thief assembly 95 to allow placement of the wafer into and removal of the wafer from the assembly 510.

Figure 18:
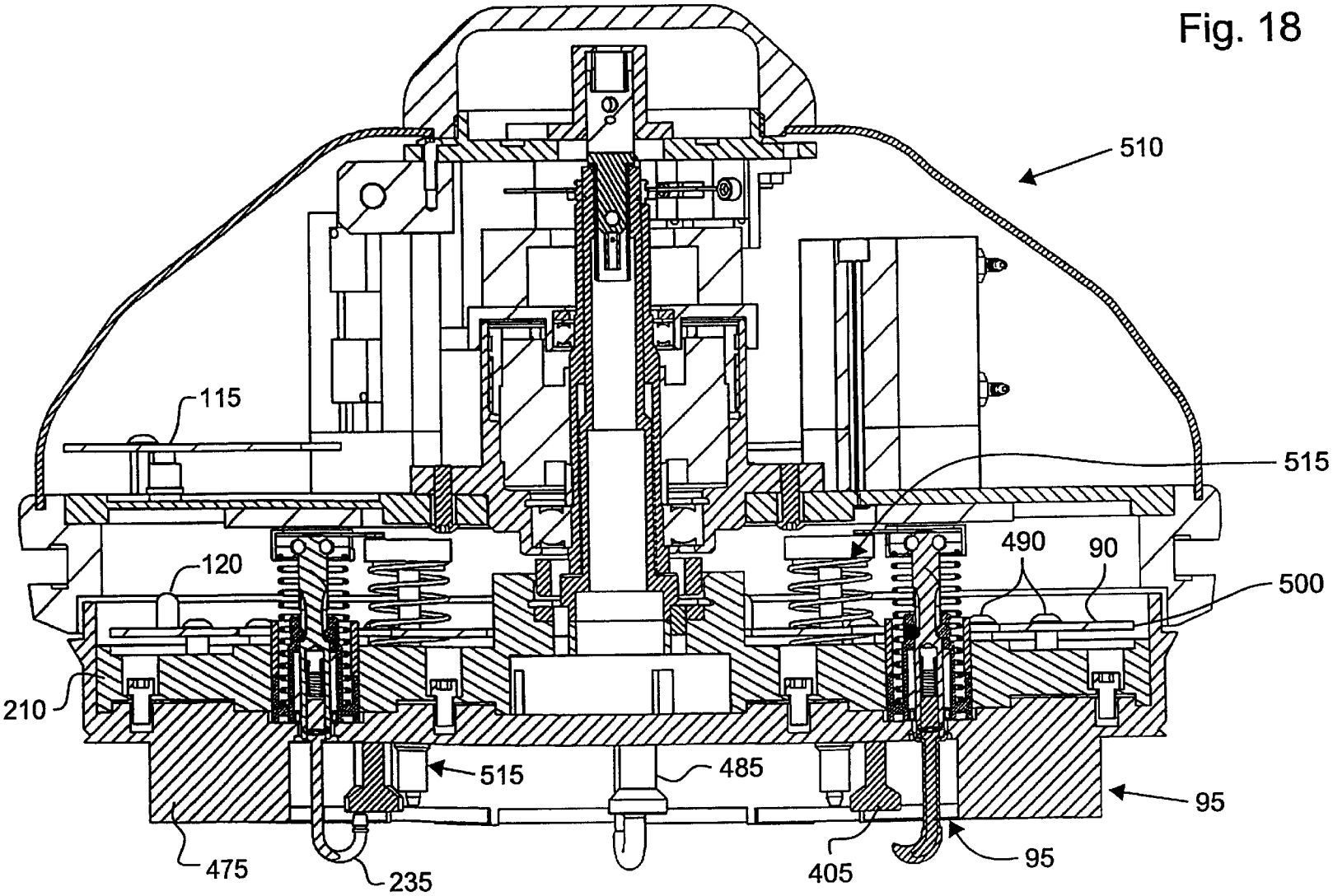

FIG. 18 illustrates the rotor assembly 80 in its home position with respect to the stator assembly 85. In this position, the IR transmit links 115 and 120 are aligned for communication.

Other embodiments of the control system of FIGS. 9–14 are also suitable for use with the current thief assembly 95. For example, the control system may be implemented without a processor, instead allowing the processor of the stator control system 110 to shift the resistor selection data bit-by-bit through shift registers of the current control system 90. In such instances, further IR links may be used to communicate shift register timing signals to the system 90 to allow the stator control system 110 to control the shifting operations. Such timing signals are specific to the particular manner in which the current control system is designed and are not particularly pertinent here.

Numerous modifications may be made to the foregoing system without departing from the basic teachings thereof. Although the present invention has been described in substantial detail with reference to one or more specific embodiments, those of skill in the art will recognize that changes may be made thereto without departing from the scope and spirit of the invention as set forth in the appended claims.

What is claimed is:

1. An apparatus for use in electroplating a wafer comprising:

a rotor assembly;

a cathode assembly disposed on the rotor assembly for co-rotation with the rotor assembly, the cathode assembly comprising a plurality of conductive fingers disposed to contact and support the wafer, a plurality of conductive segments disposed to substantially surround a peripheral region of the wafer;

a current controller disposed on the rotor assembly for co-rotation with the rotor assembly for selectively controlling current flow through each of the plurality of conductive fingers and each of the plurality of conductive segments on an individual basis during electroplating of the wafer, the current controller including an electromagnetic communications link;

a stator assembly accepting the rotor assembly;

a stator control system, the stator control system comprising an electromagnetic communications link for communicating information to the electromagnetic communications link of the current controller, the current controller using the received information to specify current set-points used for selectively controlling the current flow through each of the plurality of conductive fingers and each of the plurality of conductive segments on an individual basis during electroplating of the wafer.

2. An apparatus as claimed in claim 1 wherein the electromagnetic communications links of the current controller and the stator control system are optical links.

3. An apparatus as claimed in claim 1 wherein the current controller comprises:

a first plurality of resistance devices each associated with a respective one of the plurality of conductive fingers and regulating current through the respective conductive finger during electroplating of the wafer;

a second plurality of resistance devices each associated with a respective one of the plurality of conductive segments and regulating current through the respective conductive segment during electroplating of the wafer.

4. An apparatus as claimed in claim 3 wherein at least one resistance device of the first plurality of resistance devices comprises at least one field effect transistor device connected to receive current flow therethrough from the respective conductive finger, the at least one field effect transistor device being responsive to a voltage source connected thereto to regulate the current flow.

5. An apparatus as claimed in claim 3, wherein at least one resistance device of the second plurality of resistance devices comprises at least one field effect transistor device connected to receive current flow therethrough from the respective conductive segment, the at least one field effect transistor device being responsive to a voltage source connected thereto to regulate the current flow through the respective segment during electroplating of the wafer.

6. An apparatus as claimed in claim 3 wherein each resistance device of the first plurality of resistance devices comprises at least one field effect transistor device connected to receive current flow therethrough from the respective conductive finger, the at least one field effect transistor device being responsive to a voltage source connected thereto to regulate the current flow.

7. An apparatus as claimed in claim 3 wherein each resistance device of the second plurality of resistance devices comprises at least one field effect transistor device connected to receive current flow therethrough from the respective conductive segment, the at least one field effect transistor device being responsive to a voltage source connected thereto to regulate the current flow through the respective segment during electroplating of the wafer.

8. An apparatus as claimed in claim 3 wherein at least one of the resistance devices of the first plurality of resistance devices comprises a plurality of fixed resistors selectively connected in parallel with one another to receive current from the respective conductive finger through selected ones of the plurality of fixed resistors during electroplating of the wafer.

9. An apparatus as claimed in claim 3 wherein at least one of the resistance devices of the second plurality of resistance devices comprises a plurality of fixed resistors selectively connected in parallel with one another to receive current from the respective conductive segment through selected ones of the plurality of fixed resistors during electroplating of the wafer.

10. An apparatus as claimed in claim 8 wherein the current controller further comprises a microcontroller system connected to selectively connect the plurality of fixed resistors in parallel with one another and to the respective conductive finger.

11. An apparatus as claimed in claim 9 wherein the current controller further comprises a microcontroller system connected to selectively connect the plurality of fixed resistors in parallel with one another and to the respective conductive segment.

12. An apparatus for use in electroplating a microelectronic workpiece comprising:

a cathode assembly comprising one or more conductive elements disposed to contact the microelectronic workpiece, a plurality of conductive segments disposed to substantially surround a peripheral region of the microelectronic workpiece;

a current controller for selectively controlling current flow through the one or more conductive elements and the plurality of conductive segments during electroplating of the microelectronic workpiece.

13. An apparatus as claimed in claim 12 wherein the current controller comprises a ;ourality of resistance devices each associated with a respective one of the plurality of conductive segments and regulating current through the respective conductive segment during electroplating of the microelectronic workpiece.

14. An apparatus as claimed in claim 13 wherein at least one of the resistance devices of the plurality of resistance devices comprises at least one field effect transistor device connected to receive current flow therethrough from the respective conductive segment, the at least one field effect transistor device being responsive to a voltage source connected thereto to regulate the current flow.

15. An apparatus as claimed in claim 13 wherein each resistance device of the plurality of resistance devices comprises at least one field effect transistor device connected to receive current flow therethrough from the respective conductive segment, the at least one field effect transistor device being responsive to a voltage source connected thereto to regulate the current flow.

16. An apparatus as claimed in claim 13 wherein at least one of the resistance devices of the plurality of resistance devices comprises a plurality of fixed resistors selectively connected in parallel with one another to receive current from the respective conductive segment through selected ones of the plurality of fixed resistors.

17. An apparatus as claimed in claim 16 wherein the current controller further comprises a microcontroller system connected to selectively connect the plurality of fixed resistors in parallel with one another and to the respective conductive segment.

18. An apparatus as claimed in claim 12 wherein the current controller comprises one or more resistance devices for regulating current through the respective one or more conductive elements during electroplating of the microelectronic workpiece.

19. An apparatus as claimed in claim 18 wherein at least one of the resistance devices of the one or more resistance devices comprises at least one field effect transistor device connected to receive current flow therethrough from the respective one or more conductive elements, the at least one field effect transistor device being responsive to a voltage source connected thereto regulate the current flow.

20. An apparatus as claimed in claim 18 wherein each resistance device of the one or more resistance devices comprises at least one field effect transistor device connected to receive current flow therethrough from the respective one or more conductive elements, the at least one field effect transistor device being responsive to a voltage source connected thereto regulate the current flow.

21. An apparatus as claimed in claim 18 wherein at least one of the resistance devices of the one or more resistance devices comprises a plurality of fixed resistors selectively connected in parallel with one another to receive current from the respective one or more conductive elements through selected ones of the plurality of fixed resistors.

22. An apparatus as claimed in claim 21 wherein the current controller further comprises a microcontroller system connected to selectively connect the plurality of fixed resistors in parallel with one another and to the respective one or more conductive elements.

23. An apparatus as claimed in claim 12 wherein the current controller comprises:

a first group of resistance drvices including a plurality of resistance devices each associated with a respective one of the plurality of conductive segments and regulating current through the respective conductive segment during electroplating of the microelectronic workpiece; and a second group of resistance devices including one or more resistance devices for regulating current through respective one or more conductive elements during electroplating of the microelectronic workpiece.

24. An apparatus as claimed in claim 12 further comprising a rotor upon which the cathode assembly and the current controller are disposed for rotating the cathode assembly and the current controller.

25. An apparatus as claimed in claim 24 further comprising a stator assembly for accepting the rotor assembly; and a stator control system, wherein the stator control system comprises an electromagnetic communications link; and wherein the current controller includes an electromagnetic communications link for communicating information with the electromagnetic communications link of the stator control system, the current controller using information received via the electromagnetic communications link to specify current set-points used for selectively controlling the current flow through the one or more conductive elements and the plurality of conductive segments.

26. An apparatus as claimed in claim 25 wherein the electromagnetic communications links of the current controller and the stator control system are optical links.

27. An apparatus as claimed in claim 12 wherein the one or more conductive elements disposed to contact the microelectronic workpiece comprise a plurality of conductive contact elements spaced at generally equal intervals about the periphery of the microelectronic workpiece.

28. An apparatus as claimed in claim 12 wherein the one or more conductive elements disposed to contact the microelectronic workpiece comprise a plurality of conductive fingers.

* * * * *